US007686104B2

(12) United States Patent
Singh et al.

(10) Patent No.: US 7,686,104 B2
(45) Date of Patent: Mar. 30, 2010

(54) ROLLING CONE DRILL BIT HAVING CUTTER ELEMENTS POSITIONED IN A PLURALITY OF DIFFERING RADIAL POSITIONS

(75) Inventors: Amardeep Singh, Houston, TX (US); Scott D. McDonough, Houston, TX (US); Joshua Gatell, Cypress, TX (US); Mohammed Boudrare, Houston, TX (US); Bryce A. Baker, Houston, TX (US); Parveen K. Chandila, Houston, TX (US); Brandon M. Moss, Spring, TX (US); Allen D. White, Houston, TX (US)

(73) Assignee: Smith International, Inc., Houston, TX (US)

( * ) Notice: Subject to any disclaimer, the term of this patent is extended or adjusted under 35 U.S.C. 154(b) by 630 days.

(21) Appl. No.: 11/536,299

(22) Filed: Sep. 28, 2006

(65) Prior Publication Data

US 2007/0034414 A1 Feb. 15, 2007

Related U.S. Application Data

(63) Continuation-in-part of application No. 11/203,863, filed on Aug. 15, 2005, now Pat. No. 7,370,711.

(51) Int. Cl.
*E21B 10/16* (2006.01)

(52) U.S. Cl. ..... 175/341; 175/378

(58) Field of Classification Search ..... 175/341, 175/353, 377, 378

See application file for complete search history.

(56) References Cited

U.S. PATENT DOCUMENTS 2,147,926 A * 2/1939 Scott ..... 175/353
2,687,875 A 8/1954 Morlan
3,726,350 A 4/1973 Pessier
4,187,922 A 2/1980 Phelps
4,304,440 A 12/1981 Posciri
4,334,586 A 6/1982 Schumacher
4,393,948 A 7/1983 Fernandez
4,408,671 A 10/1983 Munson (Continued)

FOREIGN PATENT DOCUMENTS

GB 2328966 3/1999

(Continued)

OTHER PUBLICATIONS

Combined Search and Examination Report for Appl. No. 0817707.3 dated Jan. 9, 2009; (5 p).

(Continued)

*Primary Examiner*—Daniel P Stephenson
(74) *Attorney, Agent, or Firm*—Conley Rose, P.C.

(57) ABSTRACT

A drill bit for drilling through earthen formations and forming a borehole. In an embodiment, the bit comprises a bit body having a bit axis. In addition, the bit comprises a plurality of cone cutters, each of the cone cutters being mounted on the bit body and adapted for rotation about a different cone axis. Further, at least one cone cutter on the bit comprises an array of cutter elements mounted in a band. Still further, the cutter elements in the array are mounted in a plurality of differing radial positions relative to the bit axis.

47 Claims, 17 Drawing Sheets

U.S. PATENT DOCUMENTS

| | | | | |
|---|---|---|---|---|
| 4,420,050 | A | | 12/1983 | Jones |
| 4,427,081 | A | | 1/1984 | Crawford |
| 4,815,342 | A | | 3/1989 | Brett et al. |
| 4,832,136 | A | | 5/1989 | Mattsson et al. |
| 4,936,398 | A | | 6/1990 | Auty et al. |
| 4,940,099 | A | | 7/1990 | Deane et al. |
| RE34,167 | E | | 1/1993 | Mattsson et al. |
| 5,224,560 | A | | 7/1993 | Fernandez |
| 5,429,201 | A | | 7/1995 | Saxman |
| 5,456,328 | A | | 10/1995 | Saxman |
| 5,547,033 | A | * | 8/1996 | Campos, Jr. ..... 175/331 |
| 5,839,526 | A | | 11/1998 | Cisneros et al. |
| 6,131,676 | A | | 10/2000 | Friant et al. |
| 6,161,634 | A | | 12/2000 | Minikus et al. |
| 6,176,329 | B1 | | 1/2001 | Portwood et al. |
| 6,415,687 | B2 | | 7/2002 | Saxman |
| 6,834,733 | B1 | | 12/2004 | Maouche et al. |
| 6,988,569 | B2 | | 1/2006 | Lockstedt et al. |
| 7,059,431 | B2 | | 6/2006 | Simon et al. |
| 2002/0023783 | A1 | | 2/2002 | Skyles |
| 2004/0045743 | A1 | | 3/2004 | Lockstedt et al. |
| 2004/0118609 | A1 | | 6/2004 | Dennis |
| 2007/0114072 | A1 | | 5/2007 | McDonough et al. |

FOREIGN PATENT DOCUMENTS

| | | |
|---|---|---|
| GB | 2399373 | 9/2004 |
| GB | 2415976 | 11/2006 |
| GB | 2429221 | 2/2007 |
| GB | 2444860 | 6/2008 |

OTHER PUBLICATIONS

Search Report and Examination Report for Appl. No. 0623478.5 dated Dec. 5, 2008 (5 p.).

UK Combined Search and Examination Report for Appl. No. GB0623478.5 dated Feb. 2, 2007; (6 p.).

* cited by examiner

ROLLING CONE DRILL BIT HAVING CUTTER ELEMENTS POSITIONED IN A PLURALITY OF DIFFERING RADIAL POSITIONS

CROSS-REFERENCE TO RELATED APPLICATIONS

This application is a continuation in part of U.S. application Ser. No. 11/203,863 filed Aug. 15, 2005, and entitled "Rolling Cone Drill Bit Having Non-Circumferentially Arranged Cutter Elements," which is hereby incorporated herein by reference in its entirety.

STATEMENT REGARDING FEDERALLY SPONSORED RESEARCH OR DEVELOPMENT

Not Applicable.

BACKGROUND OF THE TECHNOLOGY

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutter element placement so as to decrease the likelihood of bit tracking.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form the new borehole by a combination of gouging and scraping or chipping and crushing.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutter elements upon the cone cutters greatly impact bit durability and ROP, and thus are critical to the success of a particular bit design.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding notion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearings, and ultimately lead to bit failure.

Conventional bits also typically include one or more rows of gage cutter elements. Gage cutter elements are mounted adjacent to the heel surface but orientated and sized in such a manner so as to cut the corner of the borehole. In this orientation, the gage cutter elements generally are required to cut both the borehole bottom and sidewall. The lower surface of the gage cutter elements engage the borehole bottom, while the radially outermost surface scrapes the sidewall of the borehole.

Conventional bits also include a number of additional rows of cutter elements that are located on the cones in rows disposed radially inward from the gage row. These cutter elements are sized and configured for cutting the bottom of the borehole and are typically described as inner row cutter elements and, as used herein, may be described as bottomhole cutter elements. Such cutters are intended to penetrate and remove formation material by gouging and fracturing formation material. In many applications, inner row cutter elements are relatively longer and sharper than those typically employed in the gage row or the heel row where the inserts ream the sidewall of the borehole via a scraping or shearing action.

A condition detrimental to efficient and economical drilling is known as "tracking." Tracking occurs when the inserts or cutting teeth of a cone cutter fall into the same depressions or indentations that were made by the bit during a previous revolution. Because the cutter elements penetrate into an indentation previously formed, rather than making a fresh indentation that is offset from prior indentations, the disintegration action of the cutting elements is less efficient. Thus, tracking prevents the cutter elements from fully and efficiently penetrating and disengaging the formation material at the bottom of the borehole. Further, tracking often results in a pattern of ridges and valleys, known as "rock teeth" or "rock ribs," on the bottom of the borehole. These ridges of uncut formation may contact the cone steel and tend to redistribute the weight-on-bit from the relatively sharp crests of the cutter elements to the surface of the cone cutters, thereby reducing the total force acting on the cutter elements and making it more difficult for the cutter elements to reach the uncut rock at the bottom of the valleys. Thus, tracking slows the drilling process and makes it more costly.

The contact between the cone steel and the ridges of uncut formation that often result from tracking not only impedes deep penetration of the cutter elements, but may lead to damage to the cone and the cone bearings. Such damage may occur because the cone itself becomes more directly exposed to significant impact or transient loads which may tend to cause premature seal and/or bearing failure. Thus, tracking is known to seriously impair the penetration rate, life and performance of an earth boring bit.

Increasing ROP while maintaining good cutter and bit life to increase the footage drilled is an important goal in order to decrease drilling time and recover valuable oil and gas more economically. Decreasing the likelihood of bit tracking would further that desirable goal.

Accordingly, there remains a need in the art for a drill bit and cutting structure that tends to reduce tracking so as to yield an increase in ROP and footage drilled, and eliminate other detrimental effects.

SUMMARY OF THE PREFERRED EMBODIMENTS

In accordance with at least one embodiment of the invention, a drill bit for drilling through earthen formations and forming a borehole comprises a bit body having a bit axis. In addition, the bit comprises a plurality of cone cutters, each of the cone cutters being mounted on the bit body and adapted for rotation about a different cone axis. Further, each cone cutter on the bit comprises a first array of cutter elements mounted in a first band and a second array of cutter elements mounted in a second band that is axially spaced apart from the first band relative to the cone axis. Moreover, the cutter elements in each array are mounted in a plurality of differing radial positions relative to the bit axis.

In accordance with other embodiments of the invention, a drill bit comprises a bit body having a bit axis. In addition, the bit comprises a rolling cone cutter mounted on the bit body and adapted for rotation about a cone axis. Further, the bit comprises an array of cutter elements mounted in a plurality of differing radial positions within a band on the cone cutter, wherein each cutter element of the array has a diameter, a central axis, and a crest. Still further, the cutter elements of the array form a cutting profile when rotated into a single plane, wherein the cutting profile of the array includes at least two cutter elements spaced apart by a distance measured between the axes of the two cutter elements at crest of the two cutter elements that is at least 50% of the diameter of any cutter element within the array.

In accordance with another embodiment of the invention, a drill bit comprises a bit body having a bit axis. In addition, the bit comprises a plurality of cone cutters. Each of the cone cutters is mounted on the bit body and adapted for rotation about a different cone axis and includes an intermesh region. Further, each cone cutter includes at least one array of cutter elements mounted in a plurality of differing radial positions within a band in the intermesh region, wherein each cutter element has an extension height. The cutter elements of each array form a cutting profile when rotated into a single plane. Further, the cutter elements mounted on the plurality of cones form a composite cutting profile when the plurality of cones are rotated into a single plane, the composite cutting profile including an intermesh region. Still further, the cutting profile of each array in the composite cutting profile at least partially overlaps with the cutting profile of another array on an adjacent cone. Moreover, the composite cutting profile includes a plurality of cutting voids, wherein each cutting void within the intermesh region of the composite cutting profile has a depth less than 75% of the extension height of any cutter element in the intermesh region of the composite cutting profile.

In accordance with another embodiment of the invention, a drill bit comprises a bit body having a bit axis. In addition, the bit comprises at least two rolling cone cutters mounted on the bit body and adapted for rotation about a different cone axis, wherein each cone cutter includes an intermesh region. Further, the bit comprises an array of cutter elements mounted in a plurality of differing radial positions within a band disposed in the intermesh region of one rolling cone cutter, wherein each cutter element within the array has a central axis. Still further, the cutter elements of the array form a cutting profile when rotated into a single plane that includes at least two cutter elements having skewed axes relative to one another.

In accordance with still another embodiment of the invention, a drill bit comprises a bit body having a bit axis. In addition, the bit comprises a plurality of rolling cone cutters mounted on the bit body and adapted for rotation about a different cone axis, wherein each cone cutter includes an intermesh region. Further, the bit comprises a first array of cutter elements mounted in a plurality of differing radial positions within a band disposed in the intermesh region of a first cone cutter, wherein the cutter elements of the first array for a cutting profile when rotated into a single plane. Still further, the bit comprises a plurality of cutter elements mounted in the intermesh region of a second cone cutter that form a cutting profile when rotated into a single plane. Each cutter element has an extension height. Further, the cutter elements mounted on the plurality of cone cutters form a composite cutting profile when the plurality of cone cutters are rotated into a single plane that includes an intermesh region. The cutting profile of the first array of cutter elements at least partially overlaps with the cutting profile of at least one cutter element of the second cone cutter in the composite cutting profile. Moreover, the composite cutting profile includes a cutting void between the cutting profile of the first array of cutter elements and the cutting profile of the at least one cutter element of the second cone that at last partially overlaps with the cutting profile of the first array of cutter elements. The cutting void has a depth of less than 75% of the extension height of any cutter element in the intermesh region of the composite cutting profile.

In accordance with other embodiments of the invention, a drill bit comprises a bit body having a bit axis. In addition, the bit comprises a rolling cone cutter mounted on the bit body and adapted for rotation about a cone axis. Further, the cone cutter on the bit comprises a first array of bottom hole cutter elements mounted in a first band and a second array of bottom hole cutter elements mounted in a second band that is axially spaced apart from the first band relative to the cone axis. Moreover, the cone cutter comprises a total number X of bottom hole cutter elements positioned in Y different radial positions, where the ratio of Y to X is at least 0.20.

Embodiments described herein thus comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will be made to the accompanying drawings, wherein.

DETAILED DESCRIPTION OF THE PREFERRED EMBODIMENTS

Figure 1:
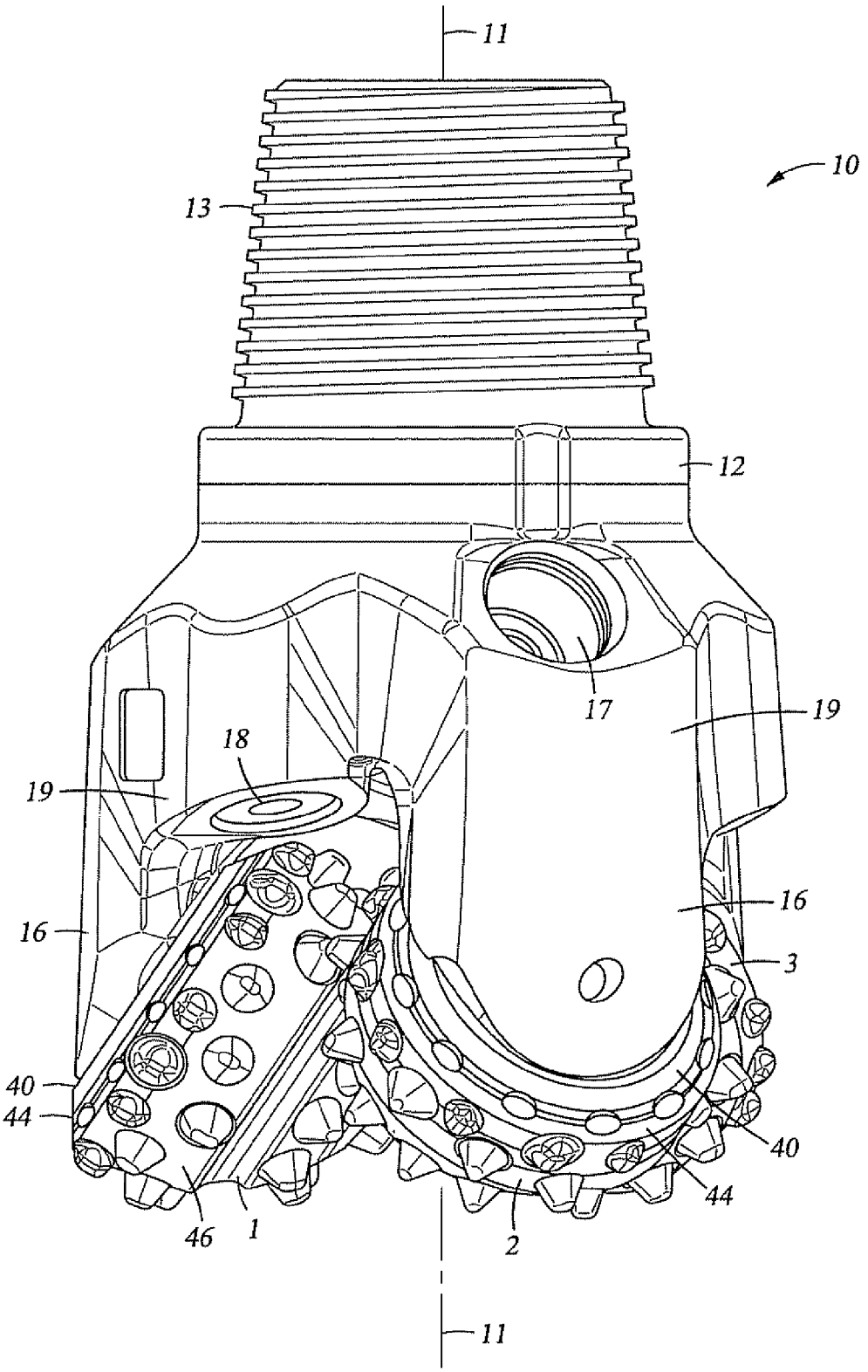
FIG. 1 is a perspective view of an embodiment of an earth-boring bit made in accordance with the principles described herein.

The following discussion is directed to various exemplary embodiments of the present invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 11 and a bit body 12 having a threaded section 13 at its upper end that is adapted for securing the bit to a drill string (not shown). Bit 10 has a predetermined gage diameter as defined by the outermost reaches of three rolling cone cutters 1, 2, 3 (cones 1 and 2 shown in FIG. 1) which are rotatably mounted on bearing shafts that depend from the bit body 12. Bit body 12 is composed of three sections or legs 19 (two legs shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter. Although the embodiment illustrated in FIG. 1 shows bit 10 as including three cone cutters 1-3, in other embodiments, bit 10 may include any number of cone cutters, such as one, two, three, or more cone cutters.

Figure 2:
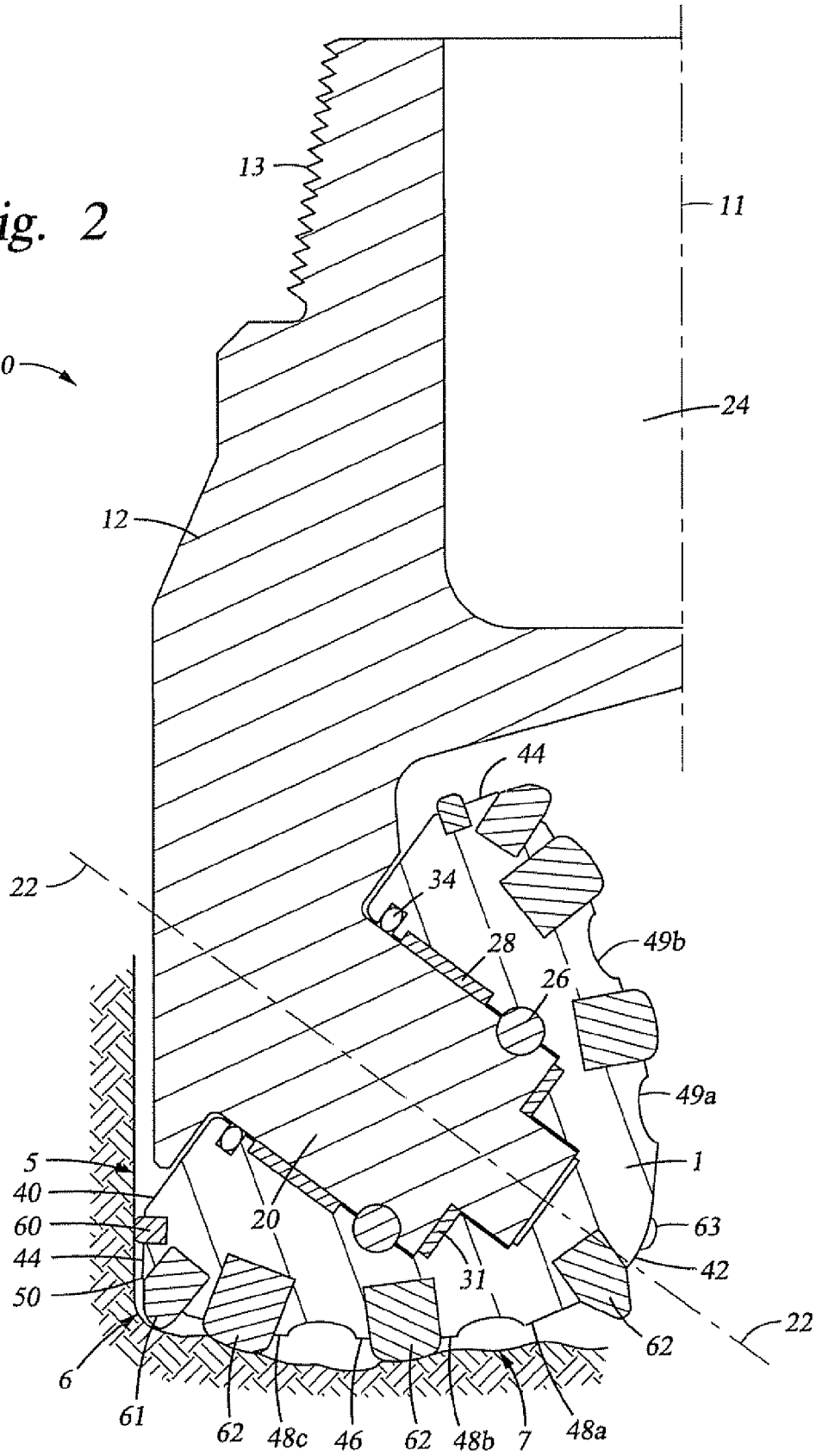
FIG. 2 is a partial section view taken through one leg and one rolling cone cutter of the bit in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by journal sleeve 28 and thrust washer 31. The bearing structure shown is generally referred to as a journal bearing or friction bearing; however, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose 42 generally opposite backface 40. Adjacent to backface 40, cutters 1-3 further include a generally frustoconical surface 44 that is adapted to retain cutter elements that scrape or ream the sidewalls of the borehole as the cone cutters 1-3 rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical cone surface 46 adapted for supporting cutter elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions 48*a-c*, generally referred to as "lands", which are employed to support and secure the cutter elements as described in more detail below. Grooves 49*a, b* are formed in cone surface 46 between adjacent lands 48*a-c*. Although only cone cutter 1 is shown in FIG. 2, cones 2 and 3 are similarly, although not identically, configured.

In bit 10 illustrated in FIGS. 1 and 2, each cone cutter 1-3 includes a plurality of wear resistant inserts or cutter elements 60, 61, 62, 63. These cutter elements each include a generally cylindrical base portion with a central axis, and a cutting portion that extends from the base portion and includes a cutting surface for cutting formation material. The cutting surface may be symmetric or asymmetric relative to the central axis. All or a portion of the base portion is secured by interference fit into a mating socket formed in the surface of the cone cutter. Thus, as used herein, the term "cutting surface" may be used to refer to the surface of the cutter element that extends beyond the surface of the cone cutter. The extension height of the insert or cutter element is the distance from the cone surface to the outermost point of the cutting surface of the cutter element as measured substantially perpendicular to the cone surface.

Figure 3A:
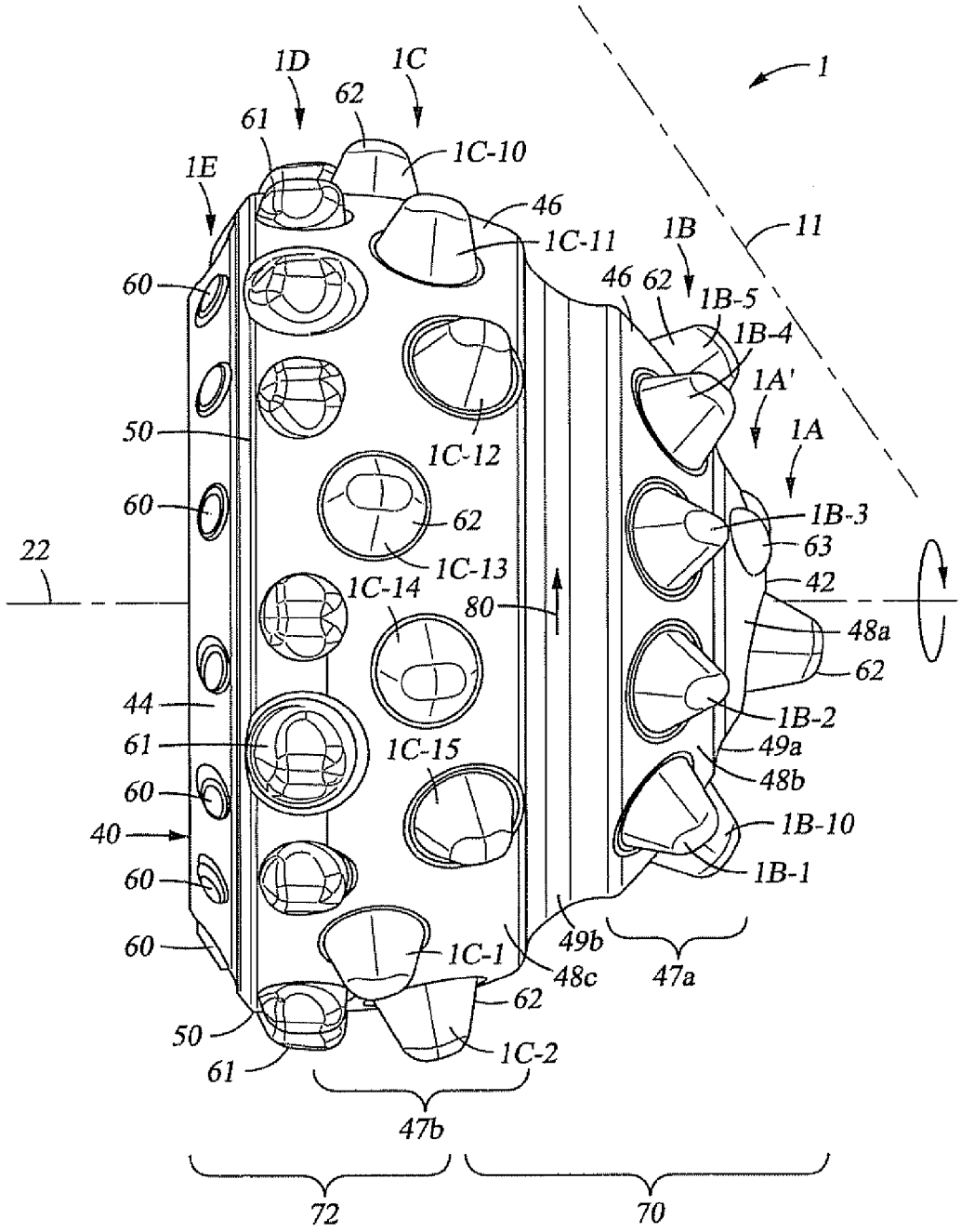
FIG. 3A is a front elevation view of one of the cone cutters of the bit shown in FIG. 1.
Figure 3B:
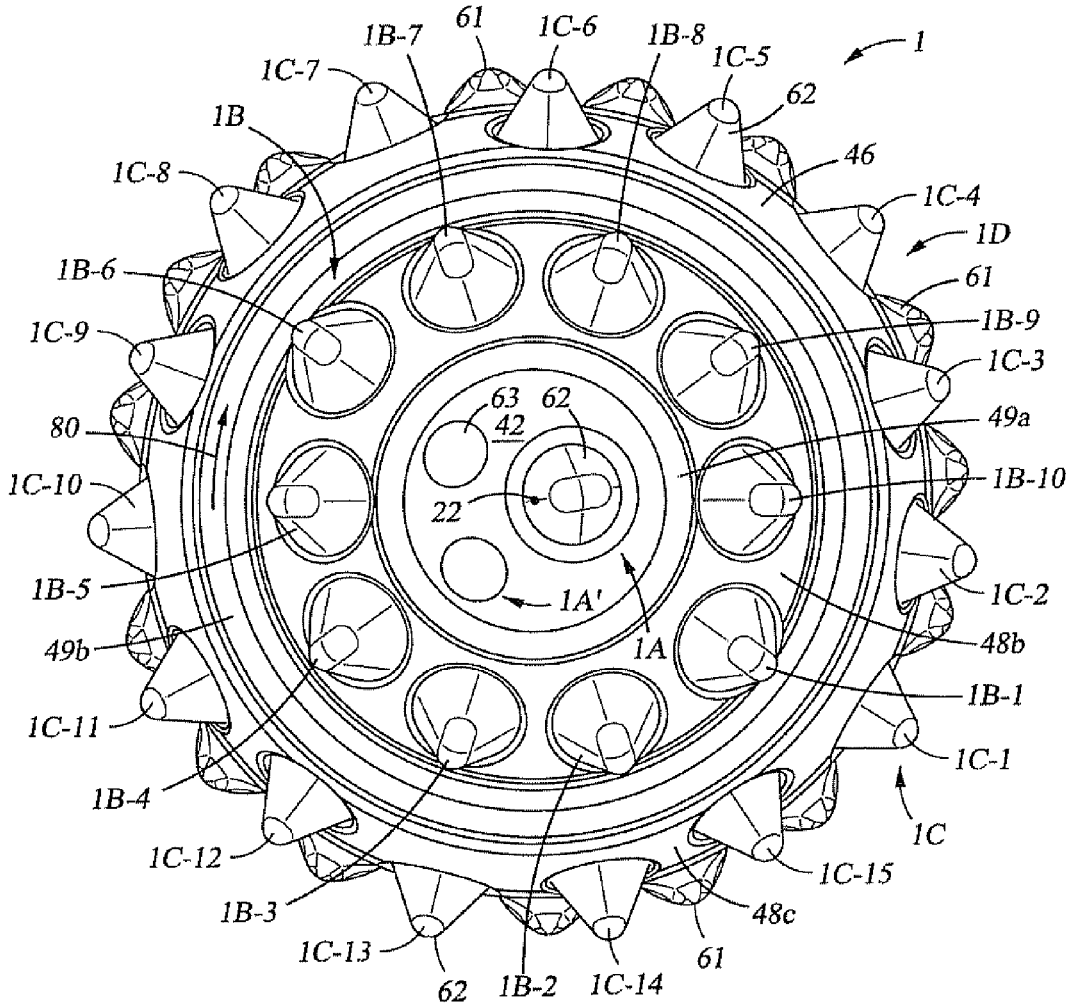
FIG. 3B is a top view of the cone cutter shown in FIG. 3A.

Referring now to FIGS. 3A and 3B, cone cutter 1 is shown in more detail and generally includes a substantially planar backface 40 and a nose 42 opposite backface 40. Cone cutter 1 further includes a generally frustoconical heel surface 44 adjacent to backface 40, and a generally conical surface 46 extending between heel surface 44 and nose 42. Cone 1 further includes a circumferential row of heel cutter elements 60 extending from heel surface 44. Heel cutter elements 60 are designed to ream borehole sidewall 5 (FIG. 2). In this embodiment, heel cutter elements 60 are generally flat-elements, topped elements, although alternative shapes and geometries may be employed.

Adjacent to shoulder 50 and radially inward of the circumferential row of heel cutter elements 60, cone 1 includes a circumferential row of gage cutter elements 61. Gage cutter elements 61 are designed to cut corner portion 6 of the borehole (FIG. 2). In this embodiment, gage cutter elements 61 include a cutting surface having a generally slanted crest, although alternative shapes and geometries may be employed. Although cutter elements 61 are referred to herein as gage or gage row cutter elements, others in the art may describe such cutter elements as heel cutters or heel row cutters.

Between the circumferential row of gage cutter elements 61 and nose 42, cone cutter 1 includes a plurality of bottomhole cutter elements 62, also sometimes referred to as inner row cutter elements. Bottomhole cutter elements 62 are designed to cut the borehole bottom 7 (FIG. 2). In this embodiment, bottomhole cutter elements 62 include cutting surfaces having a generally rounded chisel shape, although other shapes and geometries may be employed.

Cone cutter 1 further includes a plurality of ridge cutter elements 63. Ridge cutter elements 63 are designed to cut portions of the borehole bottom 7 that are otherwise left uncut by the other bottomhole cutter elements 62.

Referring still to FIGS. 3A and 3B, the cutter elements disposed on cone cutter 1 may generally be described as being disposed or positioned in six distinct groupings. Starting at nose 42, cone cutter 1 includes a group 1A of bottomhole cutter elements 62 disposed on land 48*a* and offset from cone axis 22. In this embodiment, group 1A includes a single bottomhole cutter element 62 that sweeps along a single swath or path as cone cutter 1 rotates about its axis 22.

Progressing toward backface 40, cone cutter 1 further includes an array 1B of bottomhole cutter elements 62 arranged in a band 47*a* positioned on land 48*b* which encircles cone cutter 1. Band 47*a* is distinct from and axially spaced apart from group 1A of cutter elements 62. In this embodiment, all bottomhole cutter elements 62 of array 1B are of substantially similar size and shape, although one or more cutter elements 62 of array 1B having different shapes and geometries may be employed.

Figure 4A:
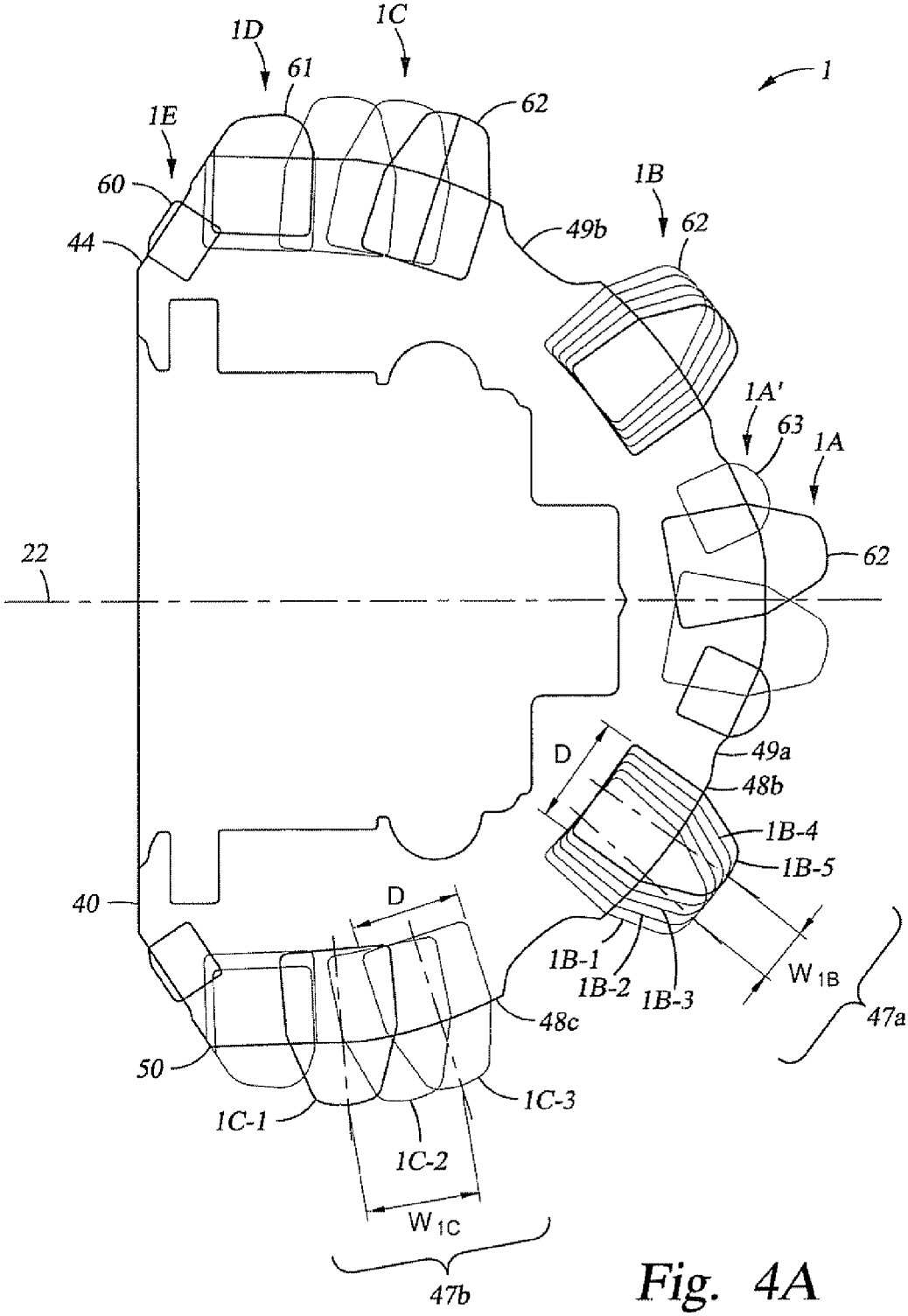
FIG. 4A is a schematic view showing, in rotated profile, the cutting profiles of the cutter elements disposed in the cone cutter shown in FIG. 3A.

As will be described in more detail below, cutter elements 62 of array 1B are not disposed in a conventional circumferential row but rather, cutter elements 62 of array 1B are disposed in a plurality of differing radial positions with respect to bit axis 11. In addition, the cutting profile of each cutter element 62 of array 1B overlaps with the cutting profile of at least one other cutter element 62 of array 1B when array 1B is viewed in rotated profile as shown in FIG. 4A. Having this arrangement, cutter elements 62 of array 1B are described as being arranged in an array. Thus, as used herein, the term "array" refers to an arrangement of two or more cutter elements within a band, where at least two cutter elements have differing radial positions relative to bit axis 11, and where the cutting profile of each cutter element within the arrangement partially, but not wholly, overlaps with the cutting profile of at least one other cutter element within the same arrangement when the array is viewed in rotated profile. Therefore, it should be understood that an arrangement of two or more axially spaced apart conventional circumferential rows of cutter elements would not be an array since each cutter element within a circumferential row completely overlaps with every other cutter element within the same row when viewed in rotated profile, and further, the cutter elements within one circumferential row do not partially overlap with the cutter elements of another axially spaced apart circumferential row when viewed in rotated profile.

Figure 4B:
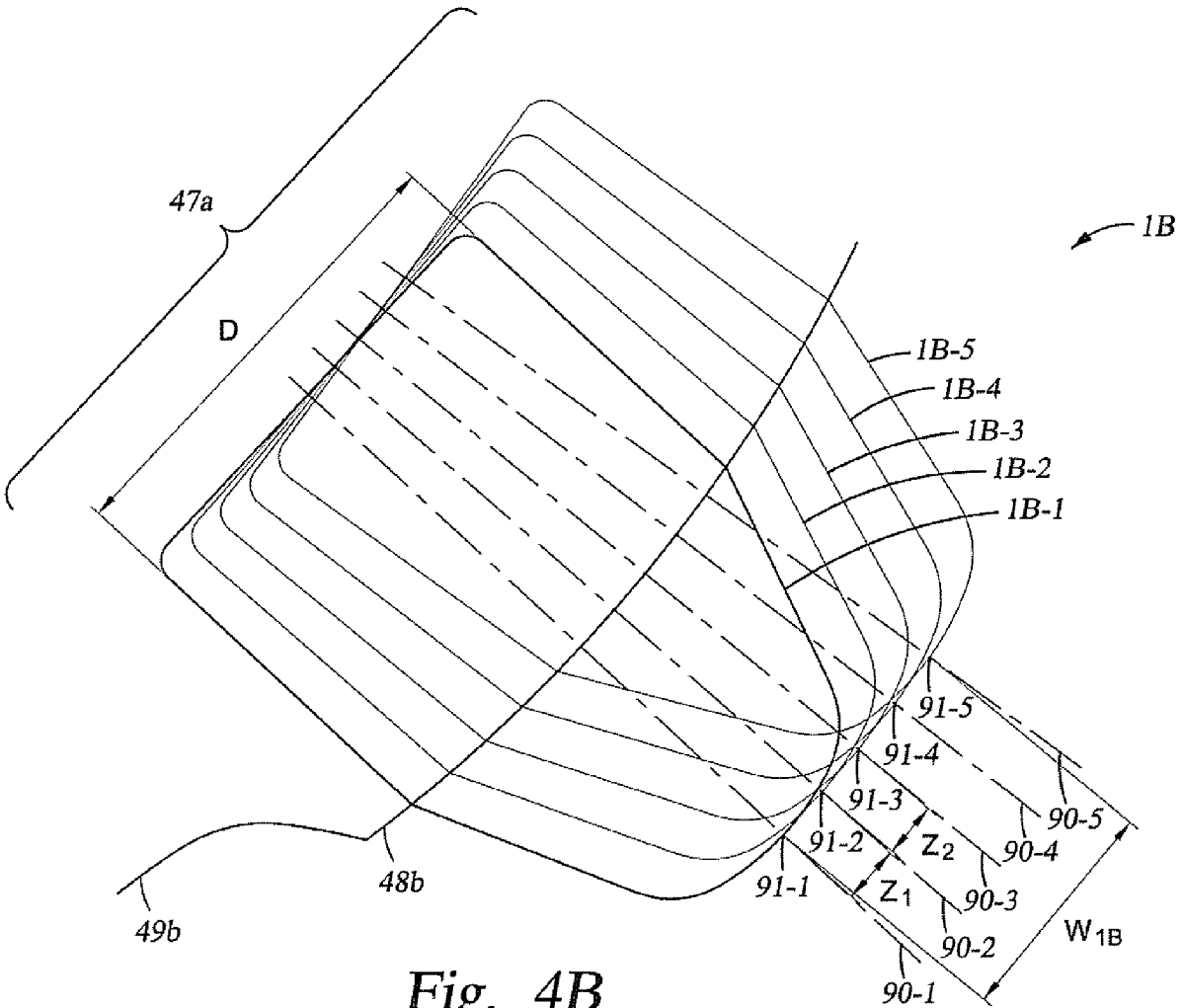
FIG. 4B is a partial enlarged schematic view showing, in rotated profile, the cutting profiles of selected cutter elements disposed in the cone cutter shown in FIG. 3A.
Figure 4C:
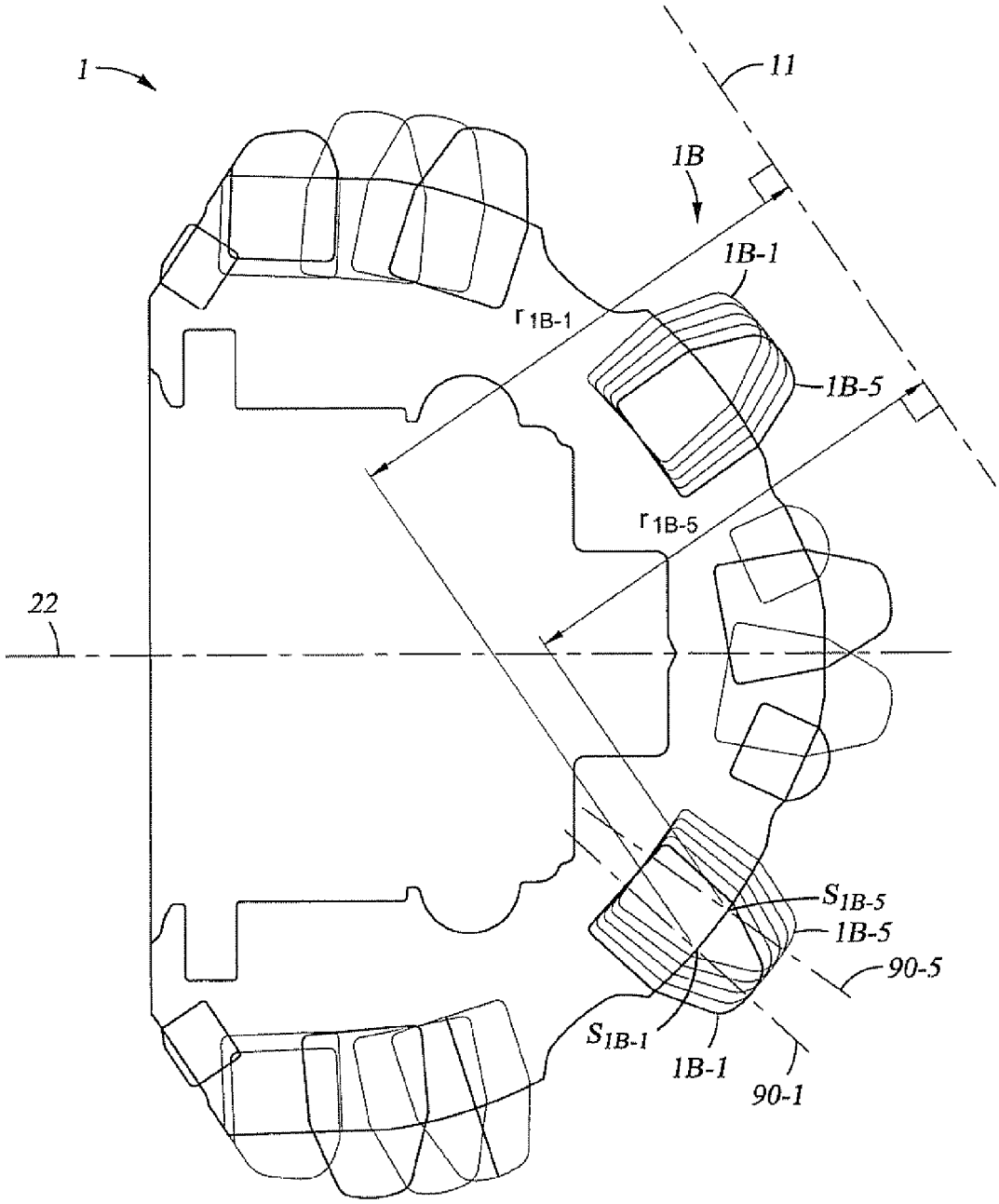
FIG. 4C is a partial schematic view of FIG. 4A, illustrating the plurality of differing radial positions of cutter elements of the cone cutter shown in FIG. 3A.

Referring now to FIG. 4C, as noted above, cutter elements 62 of array 1B are disposed in a plurality of differing radial positions with respect to bit axis 11. The radial position of a particular cutter element on a cone cutter is measured from the bit axis 11 (perpendicularly to bit axis 11) to the central axis of the cutter element at the surface of the cone cutter when the particular cutter element is furthest from to bit axis 11 (or at its bottom-most or bottom-hole engaging position) when viewed in rotated profile. For instance, cutter element 1B-1 has a central axis 90-1 that intersects the surface of cone 1 at surface intersection $S_{1B\text{-}1}$ when viewed in rotated profile. The radial position of cutter element 1B-1 can be defined by radial distance $r_{1B\text{-}1}$ measured from bit axis 11 (perpendicularly to bit axis 11) to surface intersection $S_{1B\text{-}1}$ of cutter element 1B-1. Likewise, cutter element 1B-5 has a central axis 90-5 that intersects the surface of cone 1 at surface intersection $S_{1B\text{-}5}$ when viewed in rotated profile. The radial position of cutter element 1B-5 can be defined by radial distance $r_{1B\text{-}5}$ measured from bit axis 11 (perpendicularly to bit axis 11) to surface intersection $S_{1B\text{-}5}$ of cutter element 1B-5. Thus, as illustrated in FIG. 4C, cutter element 1B-1 and cutter element 1B-5 have different radial positions with respect to bit axis 11 as defined by differing radial distances $r_{1B\text{-}5}$ and $r_{1B\text{-}5}$, respectively. It is to be understood that the cutting profiles of cutter elements 1B-2 through 1B-4 are not shown in FIG. 4C for purposes of clarity and conciseness.

Further, as shown in FIG. 3A, array 1B does not span the entire surface of cone cutter 1, but rather, is limited to band 47*a* having distinct axial boundaries and a finite width. Thus, as used herein, the term "band" refers to the portion of the surface of a cone cutter that lies between two reference planes parallel to one another and perpendicular to the cone axis. For example, band 47*a* encircles cone 1 between a reference plane perpendicular to axis 22 that passes through groove 49*a* and a second reference plane perpendicular to axis 22 that passes through groove 49*b*. In this embodiment, band 47*a* substantially coincides with land 48*b*, however, this may not always the case. For example, a band may include only part of a land, and/or multiple arrays may be on the same band.

The arrangement of cutter elements 62 within array 1B is different than the conventional arrangement of cutter elements in circumferential rows where, within manufacturing tolerances, the row's elements are mounted to strike the borehole bottom at the same radial position. Cutting elements arranged in conventional circumferential rows may therefore be referred to herein as being redundant cutter elements or as being located in redundant positions since such cutter elements are positioned to cut along the same path as the cone rotates. However, since cutter elements 62 of array 1B are disposed in a plurality of differing radial positions, cutter elements 62 in array 1B do not cut along an identical paths, but instead cut along a plurality of paths that are offset or staggered from one another.

Disposed between group 1A and array 1B in this exemplary embodiment is a circumferential row 1A' including a plurality of ridge cutter elements 63. Ridge cutter elements 63 are provided to protect the cone surface, but are not considered limiting on the embodiments of the present invention.

Referring still to FIGS. 3A and 3B and continuing to move toward backface 40, cone cutter 1 includes a second array 1C of bottomhole cutter elements 62 positioned in a band 47*b* that is distinct and axially spaced apart from array 1B of band 47*a*. Band 47*b* is located on land 48*c* and is axially bounded by groove 49*b* and circumferential row of gage cutter elements 61 (row 1D discussed below). In other words, band 47*b* does not encompass the entire land 48*c*.

Similar to array 1B, cutter elements 62 of array 1C are not disposed in a circumferential row, but are instead disposed in differing radial positions relative to the bit axis 11. Consequently, cutter elements 62 in array 1C do not cut alone identical paths but rather cut offset or staggered paths resulting in broader or increased bottomhole coverage.

Adjacent to array 1C are gage cutter elements 61 which, in this embodiment, are arranged in a circumferential row 1D. Heel surface 44 retains a circumferential row 1E of heel row cutter elements 60. Although, in this embodiment, gage cutter elements 61 are arranged in a circumferential row 1D and heel cutter elements 60 are arranged in a circumferential row 1E, gage cutter elements 61 and/or heel cutter elements 60 may alternatively be arranged in arrays. In general, each gage cutter element 61 may comprise any suitable geometry, shape, size, diameter, extension height, material composition, twist angle, or combination thereof. Further, one or more gage cutter elements 61 may be different than other gage cutter elements 61. Similarly, each heel row cutter element 60 may comprise any suitable geometry, shape, size, diameter, extension height, material, twist angle, or combination thereof. Further, one or more heel row cutter elements 60 may be different than other heel row cutter elements 60. In this exemplary embodiment, gage cutter elements 61 have differing diameters, which in this case are non-uniformly spaced about the circumference of cone 1 to accommodate the placement of bottom hole cutter elements 62 in array 1C. Gage cutter elements 61 of different diameters may also be provided to increase the amount of cutting material available to cut the formation and maintain gage.

Annular groove 49*a* separates lands 48*a* and 48*b*, thereby axially separating group 1A from array 1B. Likewise, groove 49*b* separates lands 48*b* and 48*c*, thereby axially separating arrays 1B and 1C. Grooves 49*a*, 49*b* may permit increased cleaning of cone cutter 1 by allowing a greater amount of fluid flow between the adjacent rows and arrays of cutters elements. In addition, grooves, 49*a*, 49*b* may permit the cutter elements of adjacent cone cutters 2, 3 to intermesh to a greater extent with the cutter elements of cone cutter 1. Specifically, grooves 49*a* and 49*b* allow the cutting surfaces of certain bottomhole cutter elements 62 of cone cutters 2 and 3 to pass between the cutter elements 62 of group 1A and array 1B, and between array 1B and array 1C of cone cutter 1, respectively, without contacting cone surface 46 of cone cutter 1.

Figure 9:
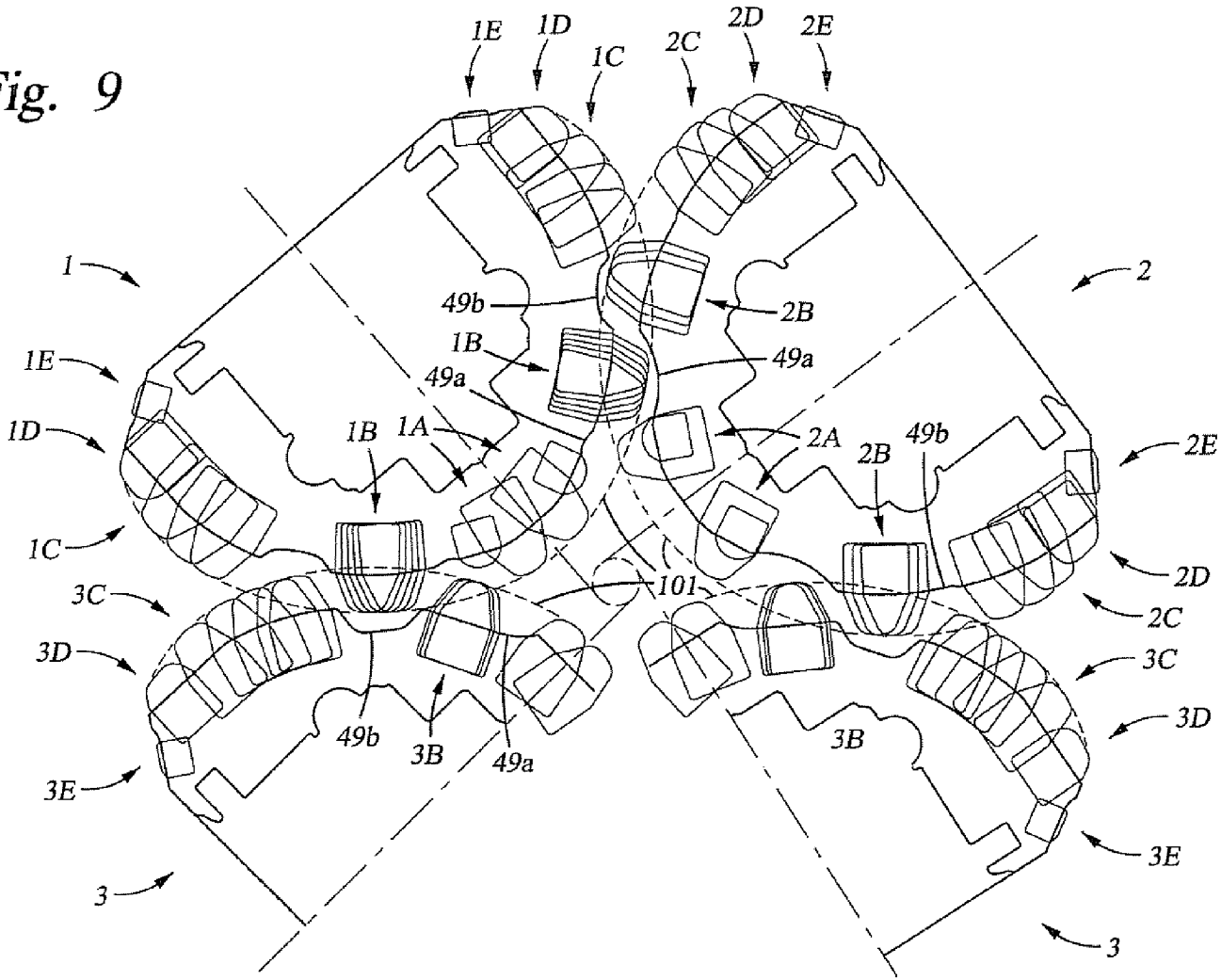
FIG. 9 is a schematic representation showing a cross-sectional view of the three rolling cones of the bit shown in FIG. 1.

Referring momentarily to FIG. 9, the intermeshed relationship between the cones 1-3 is shown. In this view, commonly termed a "cluster view," cone 3 is schematically represented in two halves so that the intermesh between cones 2 and 3 and between cones 1 and 3 may be depicted. Performance expectations of rolling cone bits typically require that the cone cutters be as large as possible within the borehole diameter so as to allow use of the maximum possible bearing size and to provide a retention depth adequate to secure the cutter element base within the cone steel. To achieve maximum cone cutter diameter and still have acceptable insert retention and protrusion, some of the rows of cutter elements are arranged to pass between the rows of cutter elements on adjacent cones as the bit rotates. In some cases, certain rows of cutter elements extend so far that clearance areas or grooves corresponding to cutting paths taken by cutter elements in these rows are provided on adjacent cones so as to allow the bottomhole cutter elements on adjacent cutters to intermesh farther. The term "intermesh" as used herein is defined to mean overlap of any part of at least one cutter element on one cone cutter with the envelope defined by the maximum extension of the cutter elements on an adjacent cutter. In FIG. 9, the intermeshed relationship between the cones 1-3 is schematically shown. Each cone cutter 1-3 has an envelope 101 defined by the maximum extension height of the cutter elements on that particular cone. The cutter elements that "intersect" or "break" the envelope 101 of an adjacent cone "intermesh" with that adjacent cone. For example, array 1B breaks envelope 101 of cone 2 and breaks envelope 101 of cone 3 and therefore intermeshes with cone 2 and cone 3. As briefly described above, and as best seen in FIG. 9, grooves 49*a* and 49*b* allow the cutting surfaces of certain bottomhole cutter elements 62 of adjacent cone cutters 2 and 3 to pass between the cutter elements 62 of group 1A and array 1B, and between array 1B and array 1C of cone cutter 1, respectively, without contacting cone surface 46 of cone cutter 1. It should be understood however, that in embodiments where the intermeshing cutter elements do not extend sufficiently far, clearance areas or grooves may not be necessary.

Referring again to FIGS. 3A and 3B, cone cutter 1 may therefore be described as being divided into an intermeshed region 70 and a non-intermeshed region 72. In general, intermeshed region 70 extends from proximal nose 42 to, and includes, the outermost cutter element (i.e., cutter element furthest from nose 42) that intermeshes with an adjacent cone. Non-intermesh region 72 generally extends from intermeshed region 70 to backface 40. As best seen in FIG. 9, group 1A, array 1B, and a portion of array 1C lie in the intermeshed region 70, while row 1D, row 1E, and the remaining portion of array 1C lie in non-intermeshed region 72 of cone cutter 1.

Referring again to FIGS. 3A and 3B, for purposes of further explanation, cutter elements 62 of array 1B are assigned reference numerals 1B-1 through 1B-10, there being ten cutter elements 62 in array 1B in this embodiment. Cutter elements 62 of array 1B are not retained in cone cutter 1 at the same radial position with respect to bit axis 11, but instead are located in a plurality of differing radial positions. Specifically, in this embodiment, each cutter element 1B-1 through 1B-10 of array 1B is disposed in one of five different radial positions within band 47*a*. Stated differently, array 1B includes $N_{1B}$ cutter elements disposed in $P_{1B}$ differing radial positions, where $N_{1B}$ is ten and $P_{1B}$ is five. In the embodiment shown in FIGS. 3A and 3B, two cutter elements of array 1B are disposed at each of the five radial positions. In particular, cutter elements 1B-1 and 1B-6 share the same radial position, cutter elements 1B-2 and 1B-7 share the same radial position, cutter elements 1B-3 and 1B-8 share the same radial position, cutter elements 1B-4 and 1B-9 share the same radial position, and cutter elements 1B-5 and 1B 10 share the same radial position.

Still referring to FIGS. 3A and 3B, cutter elements 62 of array 1C are assigned reference numerals 1C-1 through 1C-15, there being fifteen cutter elements 62 in array 1C in this embodiment. As with cutter elements 62 of array 1B, cutter elements 62 of array 1C are not retained in cone cutter 1 at the same radial position with respect to bit axis 11, but instead are located in a plurality of differing radial positions. Specifically, in this embodiment, cutter elements 1C-1 through 1C-15 are disposed in one of three different radial positions. Stated differently, array 1C includes $N_{1C}$ cutter elements disposed in $P_{1C}$ differing radial positions, where $N_{1C}$ is fifteen and $P_{1C}$ is three. In particular, cutter elements 1C-1, 1C-4, 1C-7, 1C-10, and 1C-13 share the same radial position, cutter elements 1C-2, 1C-5, 1C-8, 1C-11, and 1C-14 share the same radial position, and cutter elements 1C-3, 1C-6, 1C-9, 1C-12, and 1C-15 share the same radial position.

Referring to FIG. 4A, the twenty-six bottom hole cutter elements 62 of cone 1 are positioned in one of nine unique radial positions. The ten bottom hole cutter elements 62 of array 1B (cutter elements 1B-1 through 1B-10) are positioned in one of five differing radial positions; the fifteen bottom hole cutter elements 62 in array 1C (cutter elements 1C-1 through 1C-15) are positioned in one of three differing radial positions that each differ from the radial positions of bottom hole cutter elements 62 of array 1B; and the single bottom hole cutter element 62 of group 1A occupies a radial position differing from the radial positions of the bottom hole cutter elements 62 of array 1B and array 1C. Therefore, the ratio of unique radial positions for bottom hole cutter elements 62 to the total number of bottom hole cutter elements of cone 1 is about 0.35, or 35% (i.e., 9 radial positions divided by 26 cutter elements). Stated differently, cone 1 may be described as including a total number $X_1$ of bottom hole cutter elements 62 (e.g., $X_1$ is twenty-six in this embodiment), positioned in one of $Y_1$ different radial positions (e.g., $Y_1$ is nine in this embodiment), where the ratio of $Y_1$ to $X_1$ is about 0.35, or 35%, in this embodiment.

In general, the greater the ratio of unique radial positions for bottom hole cutter elements on a given cone to the total number of bottom hole cutter elements on the cone, the lesser the likelihood for bit tracking. Thus, the ratio of unique radial positions for bottom hole cutter elements to the total number of bottom hole cutter elements of a particular cone is preferably at least 0.20 (or 20%), and more preferably at least 0.30 (or 30%). In some embodiments, the ratio of unique radial positions for bottom hole cutter elements to the total number of bottom hole cutter elements of a particular cone may exceed 40%.

As cone cutter 1 rotates in the borehole in the direction represented by arrow 80 (FIGS. 3A and 3B), the cutter elements of cone 1 (e.g., bottomhole cutter elements 62, gage cutter elements 61, etc.) periodically hit the formation to dislodge a volume of the formation material and advance the borehole. FIG. 4A schematically illustrates the cutting surfaces and cutting profiles of each of the cutter elements of cone 1 rotated into a single plane, generally termed herein as a "rotated profile view." Thus, FIG. 4A shows the rotated profile view of cone cutter 1, including rotated profile views of group 1A of cutter elements 62, array 1B of cutter elements 62, array 1C of cutter elements 62, row 1D of gage cutter elements 61, and row 1E of heel cutter elements 60.

In general, the cutter elements on a cone cutter having substantially the same radial position with respect to the bit axis sweep along substantially the same paths through the formation as the cone rotates. Thus, for purposes of clarity, only one cutter element at a given radial position is labeled in the rotated profile views illustrated herein. For example, only cutter element 1B-1 is labeled in FIG. 4A, it being understood that cutter element 1B-6 also rotates along the same path as cutter element 1B-1 since cutter elements 1B-1 and 1B-6 share the same radial position.

Referring still to FIG. 4A, with regard to array 1B, cutter elements 1B-1 and 1B-6 include cutting surfaces that cut the closest to the borehole sidewall 5 (only cutter element 1B-1 labeled in FIG. 4A), while cutter elements 1B-5 and 1B-10, the radially-innermost cutter elements 62 of array 1B, have cutting surfaces that cut closest to bit axis 11 and furthest from the borehole sidewall 5 (only cutter element 1B-5 labeled in FIG. 4A). Cutter elements 1B-2 through 1B-4 and 1B-7 through 1B-9 cut at locations radially between cutter elements 1B-1, 1B-6 and 1B-5, 1B-10 (only cutter elements 1B-2, 1B-3, and 1B-4 labeled in FIG. 4A).

This particular array 1B of cutter elements, where a series of adjacent cutter elements are positioned progressively further from (or closer to) cone axis 22, is generally described herein as spiraled or a spiral array for simplicity. It should be understood that in other embodiments, the cutter elements of an array may not be positioned in a spiral configuration. Specifically, array 1B includes two spiral arrangements, with cutter elements 1B-1 through 1B-5 representing a first spiral arrangement, and cutter elements 1B-6 through 1B-10 representing a second spiral arrangement within band 47*a*. The first spiral arrangement represented by cutter elements 1B-1 through 1B-5 may be considered its own array since it includes two or more cutter elements (e.g., cutter elements 1B-1 and 1B-2) having differing radial positions within a band 47*a*, where the cutting profile of each cutter element 1B-1 through 1B-5 in the arrangement partially overlaps with the cutting profile of at least one other cutter element 1B-1 through 1B-5 within the same arrangement when the arrangement is viewed in rotated profile (FIG. 4A). Likewise, the second spiral arrangement represented by cutter elements 1B-6 through 1B-10 may also be considered its own array.

In some embodiments, the two or more spiral arrangements within an array (e.g., array 1B) may not repeat radial positions and instead the radial positions of each cutter element within each spiral may be unique as compared to the radial positions of cutter elements in the other spirals within the array. Such an array may be more broadly described as including a first arrangement of $N_1$ cutter elements disposed in $P_1$ differing radial positions and a second arrangement of $N_2$ cutter elements disposed in $P_2$ radial positions, where $P_1$ differing radial positions each differ from the $P_2$ differing radial positions.

Referring still to FIG. 4A, with regard to array 1C, cutter elements 1C-1, 1C-4, 1C-7, 1C-10 and 1C-13 include cutting surfaces that cut the closest to the borehole wall 5 (only cutter element 1C-1 labeled in FIG. 4A), while cutter elements 1C-3, 1C-6, 1C-9, 1C-12, and 1C-15, the radially-innermost cutter elements 62 of array 1C, have cutting surfaces that cut closest to bit axis 11 and furthest from the borehole wall 5 (only cutter element 1C-3 labeled in FIG. 4A). Cutter elements 1C-2, 1C-5, 1C-8, 1C-11, and 1C-14 (only cutter element 1C-2 labeled in FIG. 4A) cut at locations radially between cutter elements 1C-1, 1C-4, 1C-7, 1C-10, 1C-13 and cutter elements 1C-3, 1C-6, 1C-9, 1C-12, 1C-15. In this arrangement, array 1C includes five spiral arrangements, with cutter elements 1C-1 through 1C-3 representing a first spiral, cutter elements 1C-4 through 1C-6 representing a second spiral, cutter elements 1C-7 through 1C-9 representing a third spiral, cutter elements 1C-10 through 1C-12 representing a fourth spiral, and cutter elements 1C-13 through 1C-15 representing a fifth spiral. Thus, array 1C may be described as including five spiral arrangements, each spiral arrangement including three cutter elements in differing radial positions. Relative to the direction of cone rotation 80, the spiral arrangement of cutter elements 1B-1 through 1B-10 in array 1B spirals in the opposite direction as the spiral arrangement of cutter elements 1C-1 through 1C-15 in array 1C.

Referring now to FIG. 4B, an enlarged partial rotated profile view of array 1B is illustrated. Each cutter elements 1B-1 through 1B-5 includes a cutter element axis 90-1 through 90-5, respectively, and a crest 91-1 through 91-5, respectively. As best seen in FIG. 4B, the radial positions of the cutter elements 1B-1 through 1B-10 are staggered equally. In other words, the distance Z between adjacent cutter elements in rotated profile view, as measured from cutter element axis 90 at crest 91 of a cutter element to axis 90 at crest 91 of an adjacent cutter element, is uniform. For example, distance $Z_1$ between cutter elements 1B-1 and 1B-2 when viewed in rotated profile, as measured from axis 90-1 at crest 91-1 of cutter element 1B-1 to axis 90-2 at crest 91-2 of cutter element 1B-2, is substantially same as distance $Z_2$ between cutter elements 1B-2 and 1B-3, as measured from axis 90-2 at crest 91-2 of cutter element 1B-2 to axis 90-3 at crest 91-3 of cutter element 1B-3. However, as desired or required for clearance with other cutter elements, distance Z between adjacent cutter elements within an array when viewed in rotated profile may be non-uniform.

In this example, where each cutter element 1B-1 through 1B-10 of array 1B has a diameter of 0.5625 inch, Z is equal to about 0.015 inches. Preferably, for bits having diameters of between 7⅞ inch and 8¾ inch, distance Z will be between approximately 0.010 inches and 0.100 inches.

Likewise, each of the ten cutter elements 1B-1 through 1B-10 are angularly spaced about the cone axis 22 by a uniform 36° as best seen in FIG. 3B. However, as desired or required for clearance with other cutter elements, the angular positioning of the cutter elements within an array (e.g., cutter elements 1B-1 through 1B-10 of array 1B) may be non-uniform.

Although array 1B is positioned within intermesh region 70 of cone 1, in general, the principles described above apply equally to arrays disposed in non-intermesh region 70 and arrays partially in intermesh region 70 and partially in non-intermesh region 72. For instance, referring again to FIG. 4A, although each of the fifteen cutter elements 1C-1 through 1C-15 are angularly spaced about the cone axis 22 by a uniform 24°, cutter elements 1C-1 through 1C-15 may also be angularly spaced non-uniformly about cone axis 22.

Still further, in the embodiment illustrated in FIG. 4B, cutter elements 1B-1 through 1B-10 of array 1B are each positioned substantially perpendicular to cone surface 46. In other words, axis 90 of each cutter element 1B-1 through 1B-10 is substantially perpendicular to cone surface 46 in which they are disposed. Since the profile of cone surface 46 is non-planar, cutter elements 1B-1 through 1B-10 are skewed (i.e., not parallel) relative to each other. Likewise, cutter elements 1C-1 through 1C-15 of array 1C are each positioned substantially perpendicular to non-planar cone surface 46 and are thus skewed (i.e., not parallel) relative to each other. Although cutter elements 1B-1 through 1B-10 within array 1B and cutter elements 1C-1 through 1C-15 are described as skewed, in general, the cutter elements within an array (e.g., cutter elements 1B-1 through 1B-10 of array 1B) may all be substantially parallel, or with some cutter elements parallel and others skewed.

Still referring to FIG. 4B, the base portion of each cutter element 1B-1 through 1B-10 has a diameter D. In this embodiment, each cutter elements 1B-1 through 1B-10 has substantially the same diameter D, although, in general, each cutter element within an array need not have the same diameter D. Further, the cutting profile of array 1B, as represented by the overlapping cutting profiles of cutter elements 1B-1 through 1B-10 of array 1B when viewed in rotated profile, has a width $W_{1B}$ generally between the innermost cutter elements 1B-5, 1B-10 of array 1B and the outermost cutter elements 1B-1, 1B-6 of array 1B. More specifically, when array 1B is viewed in rotated profile, width $W_{1B}$ is measured from crest 91-1 of outermost cutter element 1B-1 to crest 91-5 of innermost cutter element 1B-5. Thus, in general, the width W of a particular array is the distance measured from the crest of the innermost cutter element of the array (i.e., cutter element closest to cone axis 22 and further from heel surface 44) to the crest of the outermost cutter element of an array (i.e., cutter element furthest from the cone axis 22 and closest to heel surface 44) when the cutting profile of the array is viewed in rotated profile. It being understood that the crest of a cutter element is the point on or the portion of the surface of the cutter element furthest from the cone steel. In this particular embodiment, axis 90-1 of cutter element 1B-1 intersects crest 91-1 of cutter element 1B-1, and further, axis 90-5 of cutter element 1B-5 intersects crest 91-5 of cutter element 1B-5. Thus, width $W_{1B}$ of array 1B may also be described as being measured from axis 90-1 at crest 91-1 of outermost cutter element 1B-1 to axis 90-5 at crest 91-5 of innermost cutter element 1B-5 when the cutting profile of array 1B is viewed in rotated profile. However, in other embodiments that include asymmetric cutter element(s), the axis of the innermost cutter element of the array may not intersect the crest of the innermost cutter element, and/or the axis of the outermost cutter element of the array may not intersect the crest of the outermost cutter element of the array. In such embodiments, the width W of the array is measured from the crest of the innermost cutter element of the array to the crest of the outermost cutter element of the array when the cutting profile of the array is viewed in rotated profile. In addition, it should be understood that width W of an array represents the width of the array in rotated profile (e.g., width of the cutting profile of die array) as well as the distance between the innermost and outermost cutter elements of the array.

In the embodiment illustrated in FIG. 4B, width $W_{1B}$ of array 1B is about 40% of diameter D of any cutter element within array 1B. In general, for a given cutter element geometry, the greater the width W of an array, the greater the borehole bottom coverage of the array. Thus, the width W of an array in the intermeshed region of a cone cutter is preferably greater than 25% of the diameter D of any cutter element within the array, more preferably greater than 50% of the diameter D of any cutter element within the array. In some embodiments, the width W of an array in die intermeshed region of a cone cutter may exceed 60% or even 75% of the diameter D of any cutter element within the array. However, it should be understood that increasing the width W of an intermesh array on one cone cutter (e.g., cone 1), may necessitate a smaller or reduced width W of one or more intermesh arrays on adjacent cones (e.g., cone 2 or cone 3) to allow for sufficient clearance.

As for arrays in the non-intermeshed region of a cone cutter (e.g., array 1C of cone cutter 1), clearance with cutter elements of adjacent cones is less of an issue. Thus, the width W of arrays in the non-intermeshed region of a cone cutter may exceed 50%, 75%, or even 100% of the diameter D of any cutter element within the non-intermesh array. For instance, the width $W_{1C}$ of array 1C is about 100% of diameter D.

Referring still to FIGS. 4A and 4B, as cone 1 rotates in the borehole, cutter elements 1B-1 through 1B-10 of array 1B will cut substantially the entire width $W_{1B}$ of the adjacent formation. Specifically, cutter elements 1B-1 through 1B-10 of array 1B are sufficiently sized and positioned relatively close to each other (i.e., the distance Z between adjacent cutter elements of array 1B is relatively small) such that, in rotated profile, the formation and size of cutting voids or ridges of uncut formation between the individual cutter elements 1B-1 through 1B-10 of array 1B is reduced or substantially eliminated. By reducing the formation and size of ridges of uncut formation between the individual cutter elements 1B-1 through 1B-10 of array 1B, array 1B also offers the potential to reduce the likelihood of undesirable wear and damage to cone 1 and the cutter elements of array 1B by reducing contact with relatively large segments of uncut formation.

In addition, by offsetting, staggering, and/or fanning out cutter elements 1B-1 through 1B-10 to form an array 1B (e.g., by positioning cutter elements 1B-1 through 1B-10 in a plurality of differing radial positions), the likelihood that the cutting tip of a cutter element within array 1B will fall entirely within a crater or indentation previously-formed by another cutter element of array 1B is reduced, thereby reducing the potential for bit tracking as compared to a conventional circumferential row of cutter elements. Further, by offsetting, staggering, and/or fanning out cutter elements 1B-1 through 1B-10 to form an array 1B, overall bottom hole coverage by cutting elements 1B-1 through 1B-10 can be increased as compared to a conventional circumferential row of cutter elements.

By offsetting, staggering, and/or fanning out cutter elements 1B-1 through 1B-10 to form an array 1B, while at the same time sufficiently sizing and positioning cutter elements 1B-1 through 1B-10, array 1B offers the potential for the following benefits—reduced formation and size of uncut ridges of formation, reduced likelihood of excessive wear and damage to cone 1 and the cutter elements of cone 1, reduced likelihood for bit tracking, increased bottom hole coverage as compared to a conventional circumferential row of cutter elements, and increased drilling life for the bit. One or more of these desirable benefits of array 1B may also increase the ROP of bit 10 as it drills through formation.

As with array 1B, as cone 1 rotates in the borehole, cutter elements 1C-1 through 1C-15 of array 1C will cut substantially the entire width $W_{1C}$ of the adjacent formation. Array 1C will cut a swath, leaving minimal uncut borehole bottom 7, at least between the cutter element axes of the innermost and outermost cutter elements of array 1C. In other words, cutter elements 1C-1 through 1C-15 are sized and positioned relatively close to each other (i.e., the distance Z between adjacent cutter elements in array 1C is relatively small) such that, in rotated profile, uncut ridges of formation are not formed at all, or are relatively small, between cutter elements 1C-1 through 1C-15 of array 1C. As with array 1B, by reducing, or potentially eliminating, the formation and size of ridges of uncut formation between the individual cutter elements 1C-1 through 1C-15 of array 1C, array 1C also offers the potential to reduce the likelihood of undesirable wear and damage to cone 1 and the cutter elements of cone 1.

In addition, by offsetting, staggering, and/or fanning out cutter elements 1C-1 through 1C-15 to form an array 1C (e.g., by positioning cutter elements 1C-1 through 1C-15 in a plurality of differing radial positions), the likelihood that the cutting tip of a cutter element within array 1C will fall entirely within a crater or indentation previously-formed by another cutter element of array 1C is reduced, thereby reducing the potential for bit tracking. Further, by offsetting, staggering, and/or fanning out cutter elements 1C-1 through 1C-15 for form an array 1C, overall bottom hole coverage by cutter elements 1C-1 through 1C-15 can be increased as compared to a conventional circumferential row of cutter elements.

As with array 1B discussed above, by offsetting, staggering, and/or fanning out cutter elements 1C-1 through 1C-15 to form an array 1C, while at the same time sufficiently sizing and positioning cutter elements 1C-1 through 1C-15, array 1C offers the potential for the following benefits—reduced formation and size of uncut ridges of formation, reduced likelihood of excessive wear and damage to cone 1 and the cutter elements of cone 1, reduced likelihood for bit tracking, increased bottom hole coverage as compared to a conventional circumferential row of cutter elements, and increased drill life for the bit. One or more of these desirable benefits of array 1C may also increase the ROP of bit 10 as it drills through formation.

Figure 5A:
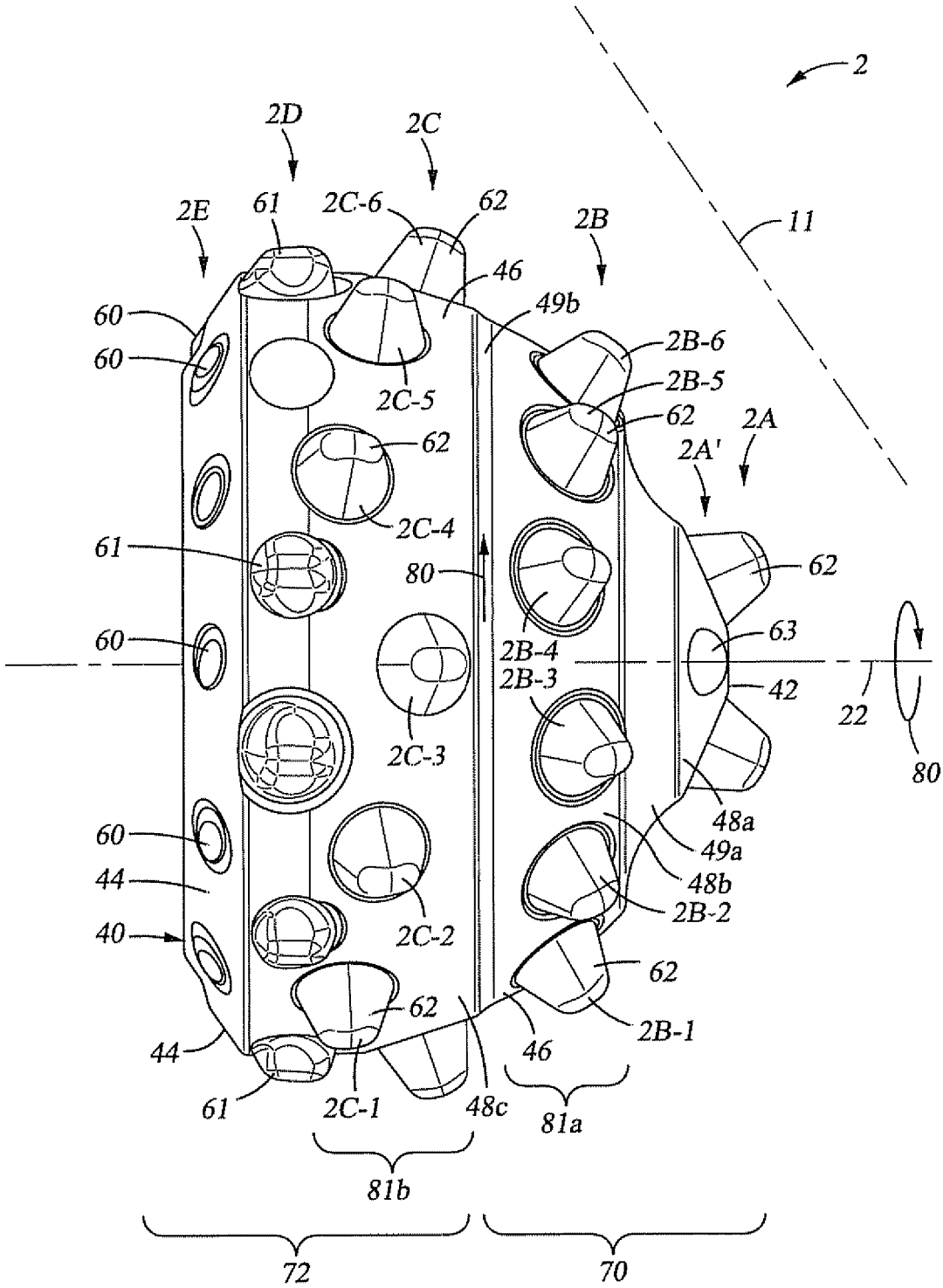
FIG. 5A is a front elevation view of another of the cone cutters of the bit shown in FIG. 1.
Figure 5B:
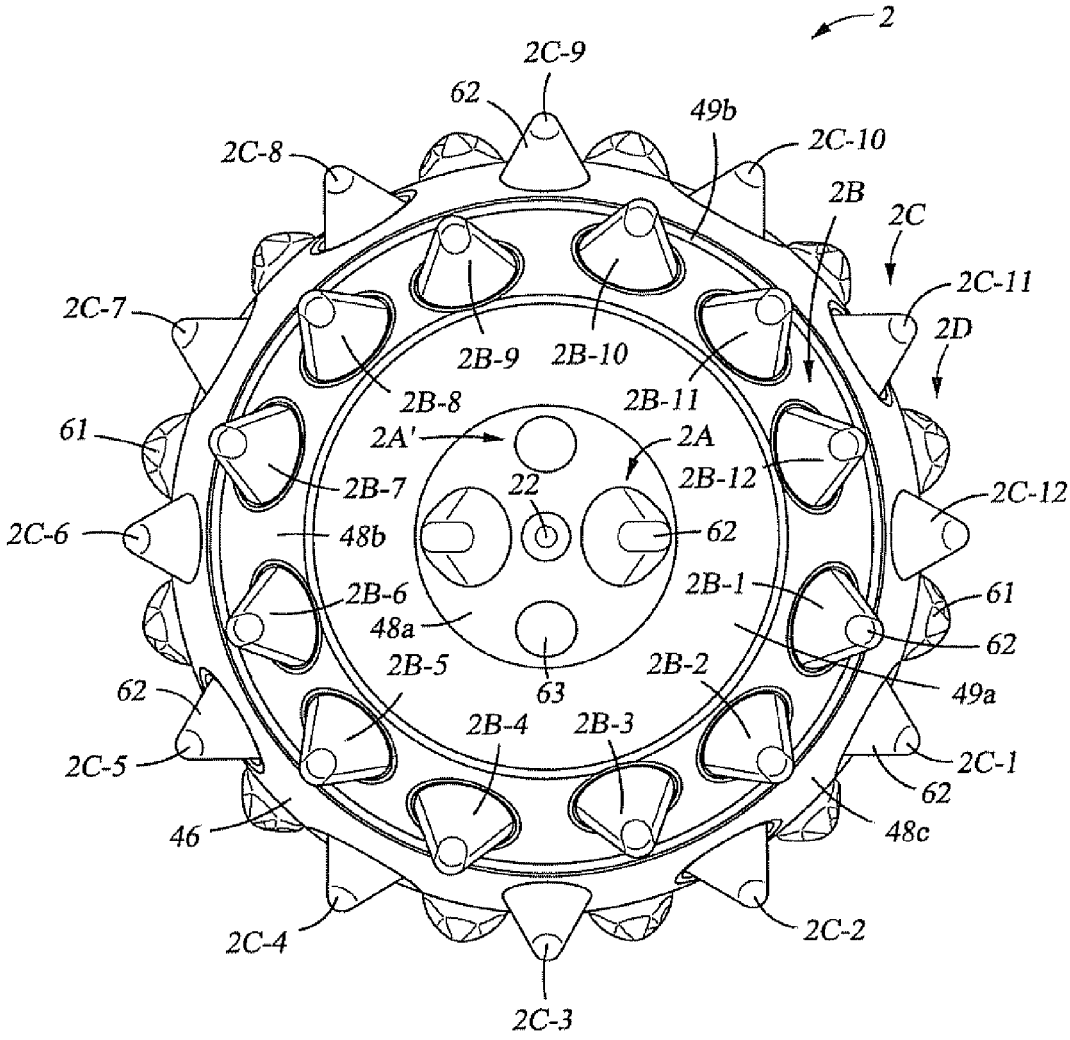
FIG. 5B is a top view of the cone cutter shown in FIG. 5A.

Referring now to FIGS. 5A and 5B, in one exemplary embodiment, cone 2 includes backface 40, nose 42, generally frustoconical heel surface 44, and generally conical surface 46 between nose 42 and heel surface 44. Likewise, cone 2 includes heel cutter elements 60, gage cutter elements 61, bottomhole cutter elements 62, and ridge cutter elements 63, all as previously described. Bottomhole cutter elements 62 are arranged in a row 2A (consisting of two cutter elements 62), a spaced-apart array 2B, and another spaced-apart array 2C. Cutter elements 62 of array 2B are disposed in a plurality of differing radial positions such that cutter elements 62 in array 2B do not cut in an identical path but instead cut in offset or staggered paths. Likewise, cutter elements 62 of array 2C are disposed in a plurality of differing radial positions such that cutter elements 62 in array 2C do not cut in an identical path. Disposed between rows 2A and 2B is a circumferential row 2A' of ridge cutting elements 63. Like cone 1, cone 2 includes a circumferential row 2D of gage cutter elements 61 spaced apart from a circumferential row 2E of heel cutter elements 60.

Referring to FIGS. 5A and 9, row 2A and array 2B of cone 2 intermesh with cutter elements of adjacent cones 1 and 3, however, array 2C does not intermesh with cutter elements of an adjacent cone 1 or 3. Thus, intermesh region 70 of cone 2 extends from proximal nose 42 to, but does not include array 2C, while non-intermesh region 72 extends from intermesh region 70 to backface 40 and includes array 2C, row 2D and row 2E.

Referring again to FIGS. 5A and 5B, array 2B includes twelve bottomhole cutter elements 62, referenced herein as cutter elements 2B-1 through 2B-12, arranged in a band 81*a* upon a frustoconical-shaped region or land 48*b* which encircles cone 2 between array 2C and nose row 2A. In particular, cutter elements 2B-1 through 2B-12 are angularly spaced about cone axis 22 by a non-uniform amount generally between 25° and 30° as best seen in FIG. 3B. In addition, array 2C includes twelve bottomhole cutter elements 62, referenced herein as elements 2C-1 through 2C-12, arranged in a band 81*b* upon a frustoconical-shaped region or land 48*c* which encircles cone 2 between gage row 2D and array 2B. Cutter elements 2C-1 through 2C-12 are also angularly spaced about cone axis 22 by a non-uniform amount as best seen in FIG. 3B. Although cutter elements 2B-1 through 2B-12 of array 2B and cutter elements 2C-1 through 2C-12 of array 2C are non-uniformly spaced about cone 2, in general, the angular spacing of cutter element in an array may be uniform or non-uniform. Row 2A and row 2A' are arranged on a land 48*a* about nose 42.

Figure 6:
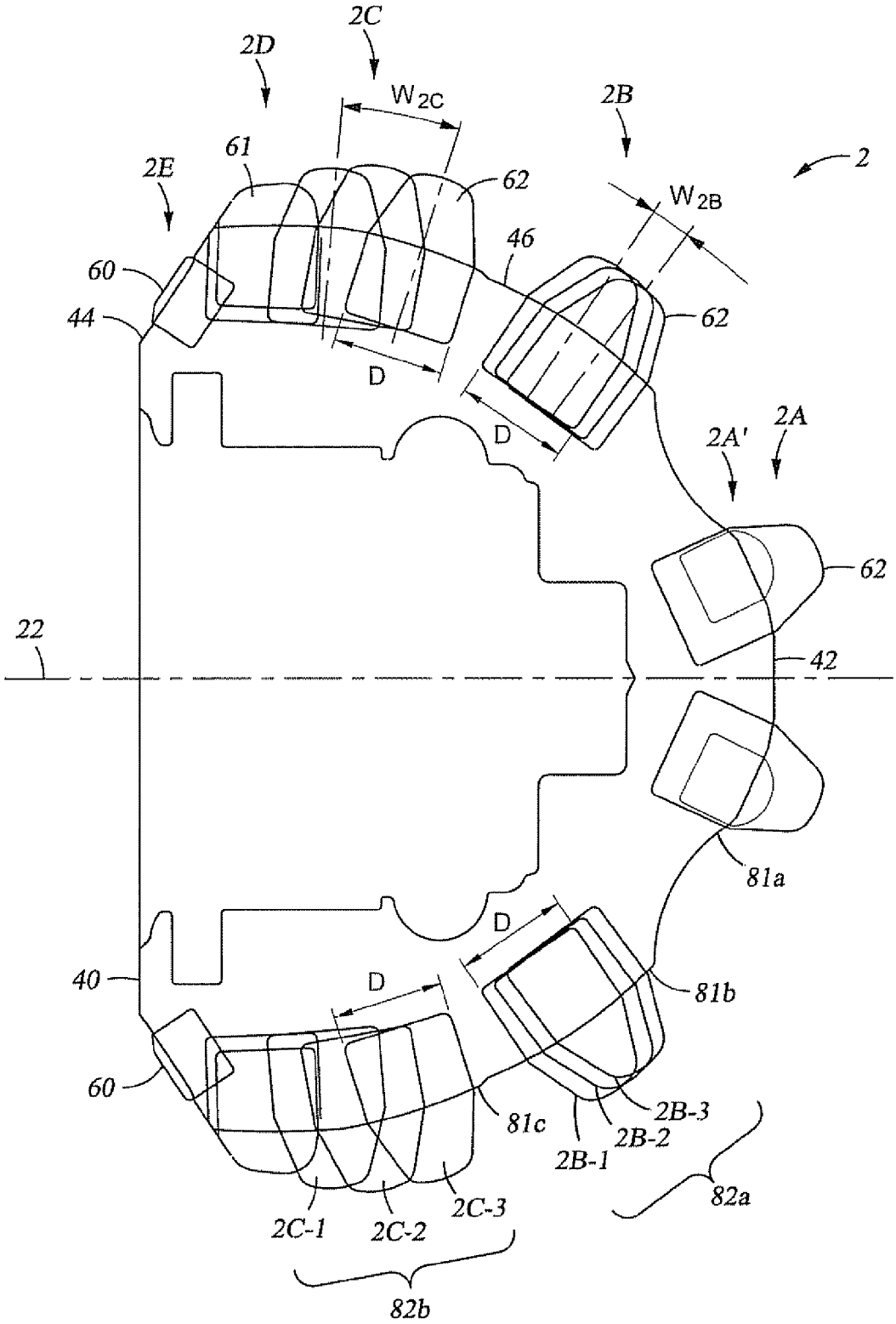
FIG. 6 is a schematic view showing, in rotated profile, the cutting profiles of the cutter elements disposed in the cone cutter shown in FIG. 5A.

Referring to FIG. 6, the twenty-six bottom hole cutter elements 62 of cone 2 are positioned in one of seven unique radial positions. Specifically, the twelve bottom hole cutter elements 62 of array 2B (cutter elements 2B-1 through 2B-12) are positioned in one of three radial positions; the twelve bottom hole cutter elements 62 of array 2C (cutter elements 2C-1 through 2C-12) are positioned in one of three radial positions that each differ from the radial positions of cutter elements 62 of array 2B; and the two bottom hole cutter elements 62 of row 2A occupy a radial position differing, from each of the radial positions of bottom hole cutter elements 62 of array 2B and array 2C. Therefore, the ratio of unique radial positions for bottom hole cutter elements 62 to the total number of bottom hole cutter elements 62 of cone 2 is about 0.27, or 27% (i.e., 7 radial positions divided by 26 total bottom hole cutter elements). Stated differently, cone 2 may be described as including a total number $X_2$ of bottom hole cutter elements 62, twenty-six total bottom hole cutter elements 62 in this embodiment (i.e., $X_2$ is twenty-six), positioned in one of $Y_2$ different radial positions, seven different radial positions for bottom hole cutter elements 62 in this embodiment (i.e., $Y_2$ is seven), where the ratio of $Y_2$ to $X_2$ is about 0.27, or 27%. Although array 2B includes twelve cutter elements 62, array 2C includes 12 cutter elements 62, and tow 2A includes two cutter elements 62 in this embodiment of cone 2, it should be understood that in general, an array or row may have any suitable number of cutter elements (e.g., cutter elements 62).

Regarding array 2B, cutter elements 2B-1, 2B-4, 2B-7, and 2B-10 share the same radial position and are positioned closest to heel surface 40 and furthest from bit axis 11 (i.e., outermost cutter elements of array 2B). Cutter elements 2B-3, 2B-6, 2B-9, and 2B-12 share the same radial position and are positioned closest to bit axis 11 and furthest from heel surface 44 (i.e., innermost cutter elements of array 2B). Remaining cutter elements 2B-2, 2B-5, 21-8, and 2B-11 share the same radial position and are positioned between the innermost cutter elements and outermost cutter elements of array 2B. In this arrangement, cutter elements 2B-1 through 2B-3, cutter elements 2B-4 through 2B-6, cutter elements 2B-7 through 2B-9, and cutter elements 2B-10 through 2B-12 each form a spiral arrangement, respectively, within array 2B. Thus, array 2B may be described as including four spiral arrangements, each spiral arrangement including three cutter elements in differing radial positions.

Regarding array 2C, cutter elements 2C-1, 2C-4, 2C-7, and 2C-10 share the same radial position and are positioned closest to heel surface 40 and furthest from bit axis 11 (i.e., outermost cutter elements of array 2C). Cutter elements 2C-3, 2C-6, 2C-9, and 2C-12 share the same radial position and are positioned closest to bit axis 11 and furthest from heel surface 44 (i.e., innermost cutter elements of array 2C). Remaining cutter elements 2C-2, 2C-5, 2C-8, and 2C-11 share the same radial position, and are positioned between the innermost cutter elements and outermost cutter elements of array 2C. In this arrangement, cutter elements 2C-1 through 2C-3, cutter elements 2C-4 through 2C-6, cutter elements 2C-7 through 2C-9, and cutter elements 2C-10 through 2C-12 each form a spiral arrangement, respectively, within array 2C. Thus, array 2C may be described as including four spiral arrangements, each spiral arrangement including three cutter elements in differing radial positions. Relative to the direction of cone rotation 80, the spiral arrangement of cutter elements 2B-1 through 2B-12 in array 2B spirals in the same direction as spiral arrangement of cutter elements 2C-1 through 2C-12 in array 2C.

Still referring to FIG. 6, the rotated profile view of array 2B, represented by the overlapping cutting profiles of cutter elements 2B-1 through 2B-12, has a width $W_{2B}$ measured as previously described. In this embodiment, width $W_{2B}$ is about 40% of diameter D of any cutter element within array 2B. Further, the rotated profile view of array 2C, represented by the overlapping cutting profiles of cutter elements 2C-1 through 2C-12, has a width $W_{2C}$ measured as previously described. In this embodiment, $W_{2C}$ is about 100% of diameter D of any cutter element within array 2C.

As best seen in FIG. 6, as cone 2 rotates in the borehole, cutter elements 2B-1 through 2B-12 of array 2B will cut substantially the entire width $W_{2B}$ of the adjacent formation. Specifically, cutter elements 2B-1 through 2B-12 of array 2B are sufficiently sized and positioned relatively close to each other (i.e., the distance Z between adjacent cutter elements of array 2B is relatively small) such that, in rotated profile, the formation and size of cutting voids or ridges of uncut formation between the individual cutter elements within array 2B is reduced or substantially eliminated. Likewise, as cone 2 rotates in the borehole, cutter elements 2C-1 through 2C-12 of array 2C will cut substantially the entire width $W_{2C}$ of the adjacent formation. As with the cutter elements of array 2B, the cutter elements 2C-1 through 2C-12 of array 2C are sufficiently sized and positioned such that, in rotated profiles the formation and size of ridges of uncut formation between the individual cutter elements 2C-1 through 2C-12 of array 2C is reduced or substantially eliminated.

By reducing the formation and size of uncut formation between the individual cutter elements within arrays 2B, 2C, arrays 2B, 2C each offer the potential to increase bottom hole coverage while reducing the likelihood of undesirable wear and damage to cone 2 and the cutter elements of cone 2 resulting from contact with relatively large segments of uncut formation.

In addition, by offsetting, staggering, and/or fanning out cutter elements 2B-1 through 2B-12 to form array 2B and cutter elements 2C-1 though 2C-12 to form array 2C (e.g., by positioning cutter elements 2B-1 through 2B-12 and cutter elements 2C-1 through 2C-12, respectively, in a plurality of differing radial positions), the likelihood that the cutting tip of a cutter element within array 2B, 2C will fall entirely within a crater or indentation previously-formed by another cutter element of array 2B, 2C, respectively, is lessened, thereby offering the potential for reduced bit tracking. Further, by offsetting, staggering and/or fanning out cutter elements 2B-1 through 2B-12 of array 2B and cutter elements 2C-1 through 2C-12 of array 2C, overall bottom hole coverage by cutter elements 2B-1 through 2B-12 and 2C-1 through 2C-12 is increased as compared to a conventional circumferential row of cutter elements.

By offsetting, staggering, and/or fanning out cutter elements 2B-1 through 2B-12 of array 2B and cutter elements 2C-1 thorough 2C-12 of array 2C, while at the same time sufficiently sizing and positioning cutter elements 2B-1 through 2B-12 of array 2B and cutter elements 2C-1 through 2C-12 of array 2C, arrays 2B, 2C each offer the potential for the following benefits—reduced formation and size of uncut ridges of formation, reduced likelihood of excessive wear and damage to cone 2 and the cutter elements of cone 2, reduced likelihood for bit tracking, increased bottom hole coverage as compared to a conventional circumferential row of cutter elements, and increased drilling life for the bit. One or more of these desirable benefits of arrays 2B, 2C may also increase the ROP of bit 10 as it drills through formation.

Figure 7A:
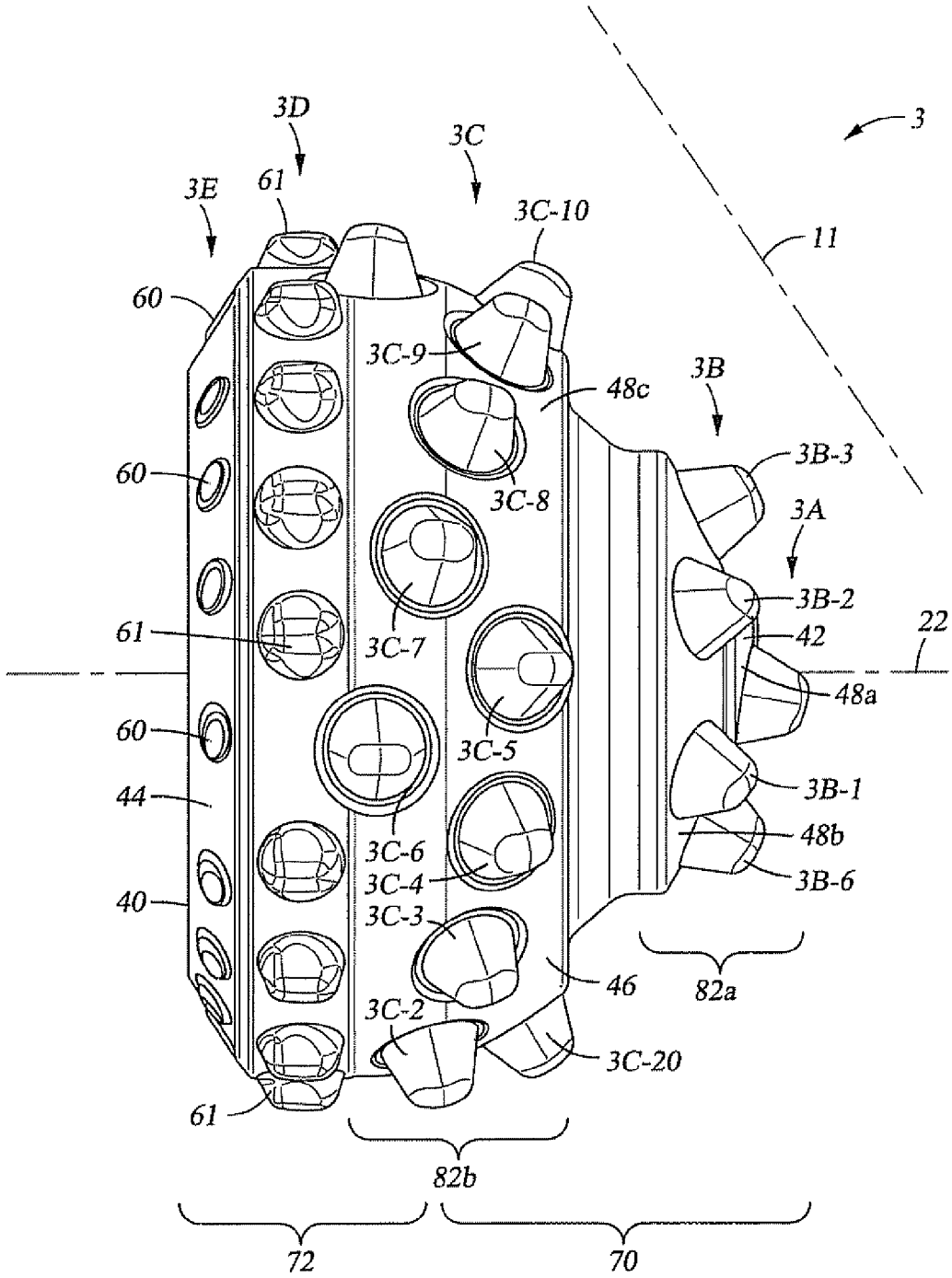
FIG. 7A is a front elevation view of one of another of the cone cutters of the bit shown in FIG. 1.
Figure 7B:
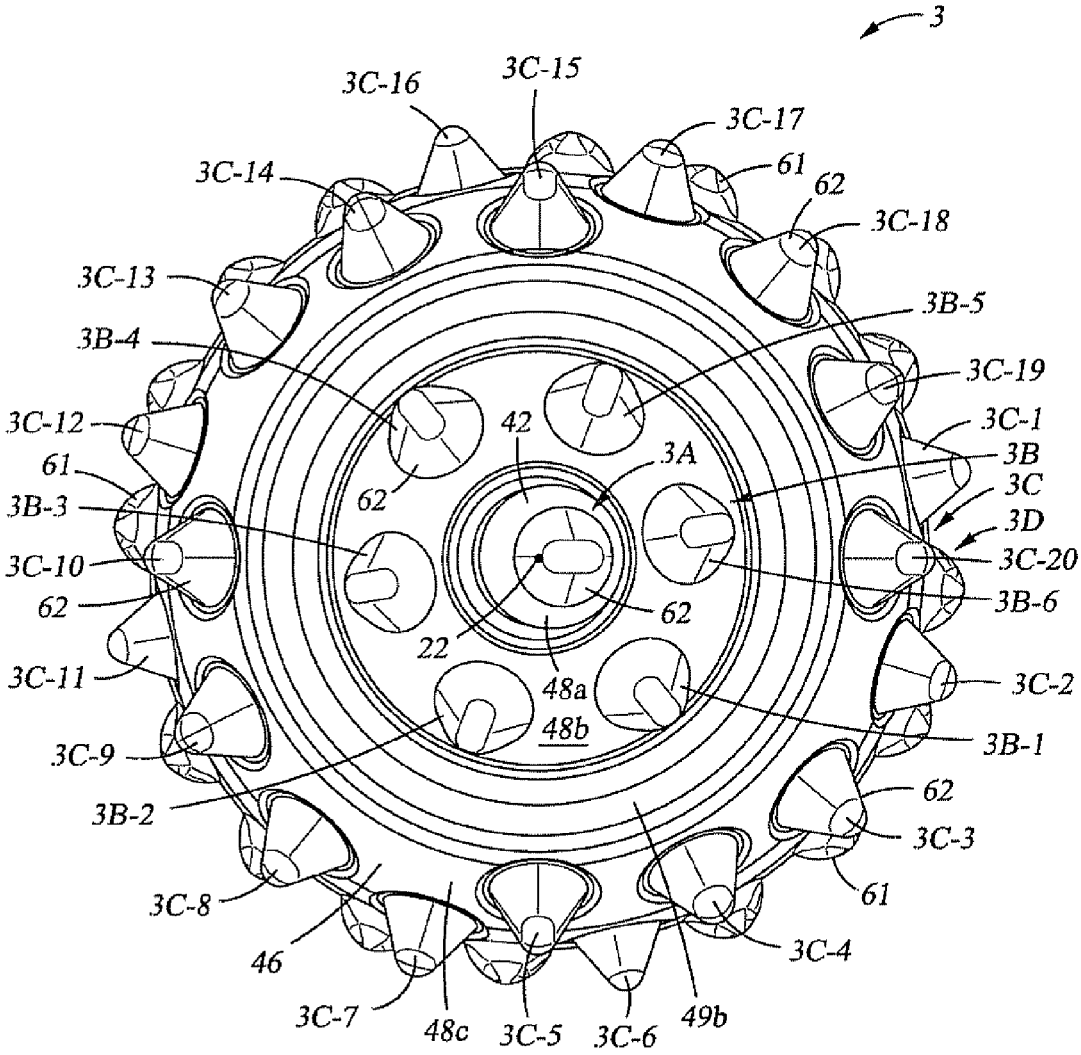
FIG. 7B is a top view of the cone cutter shown in FIG. 7A.

Referring now to FIGS. 7A and 7B, cone 3 includes backface 40, nose 42, generally frustoconical heel surface 44, and generally conical surface 46 between nose 42 and heel surface 44. Likewise, cone 3 includes heel cutter elements 60, gage cutter elements 61, and bottomhole cutter elements 62, all as previously described. Bottomhole cutter elements 62 are arranged in a group 3A (consisting of a single insert), an axially spaced-apart array 3B, and another axially spaced apart array 3C. Cutter, elements 62 of array 3B are disposed in differing, radial positions such that cutter elements 62 in array 3B do not cut in an identical path but instead cut offset or staggered paths. Similarly, cutter elements 62 of array 3C are disposed in differing radial positions such that cutter elements 62 in array 3C do not cut in an identical path. Like cones 1 and 2, cone 3 includes a circumferential row 3D of gage cutter elements 61 spaced apart from a circumferential row 3E of heel cutter elements 60.

Referring to FIGS. 7A and 9, array 3B and portions of array 3C intermesh with one or more cutter elements on adjacent cones 1 and 2. Thus, intermesh region 70 of cone 3 extends from proximal nose 42 to, and includes, cutter element 62 of array 3C that intermeshes with cutter elements of adjacent cones 1 and 2 (i.e., cutter elements 62 of array 3C that are positioned in any of lithe three radial positions closest to bit axis 22 of cone 3). Non-intermesh region 72 extends from intermesh region 70 to backface 40 and includes the cutter elements of array 3C that do not intermesh, row 3D and row 3E. Thus, cone 3 includes two separate arrays, array 3B and array 3C, within intermesh region 70.

Referring again to FIGS. 7A and 7B, array 3B includes six bottomhole cutter elements 62, referenced herein as elements 3B-1 through 3B-6, arranged in a band **82*a* upon a frustoconical-shaped region or land 48*b* which encircles cone 3 between array 3C and group 3A. In particular, the six cutter elements 3B-1 through 3B-6 are angularly spaced about cone axis 22 by a uniform 60° as best seen in FIG. 7B. Array 3C includes twenty bottomhole cutter elements 62, referenced herein as elements 3C-1 through 3C-20, arranged in a band 82*b* upon a frustoconical-shaped region or land 48*c* which encircles cone 2 between gage row 3D and array 3B. Group 3A is arranged on a land 48*a* about nose 42. In particular, the 20 cutter elements 3C-1 through 3C-20 are angularly spaced about cone axis 22 non-uniformly, but generally angularly spaced between 15° and 20° apart as best seen in FIG. 7B**.

Figure 8:
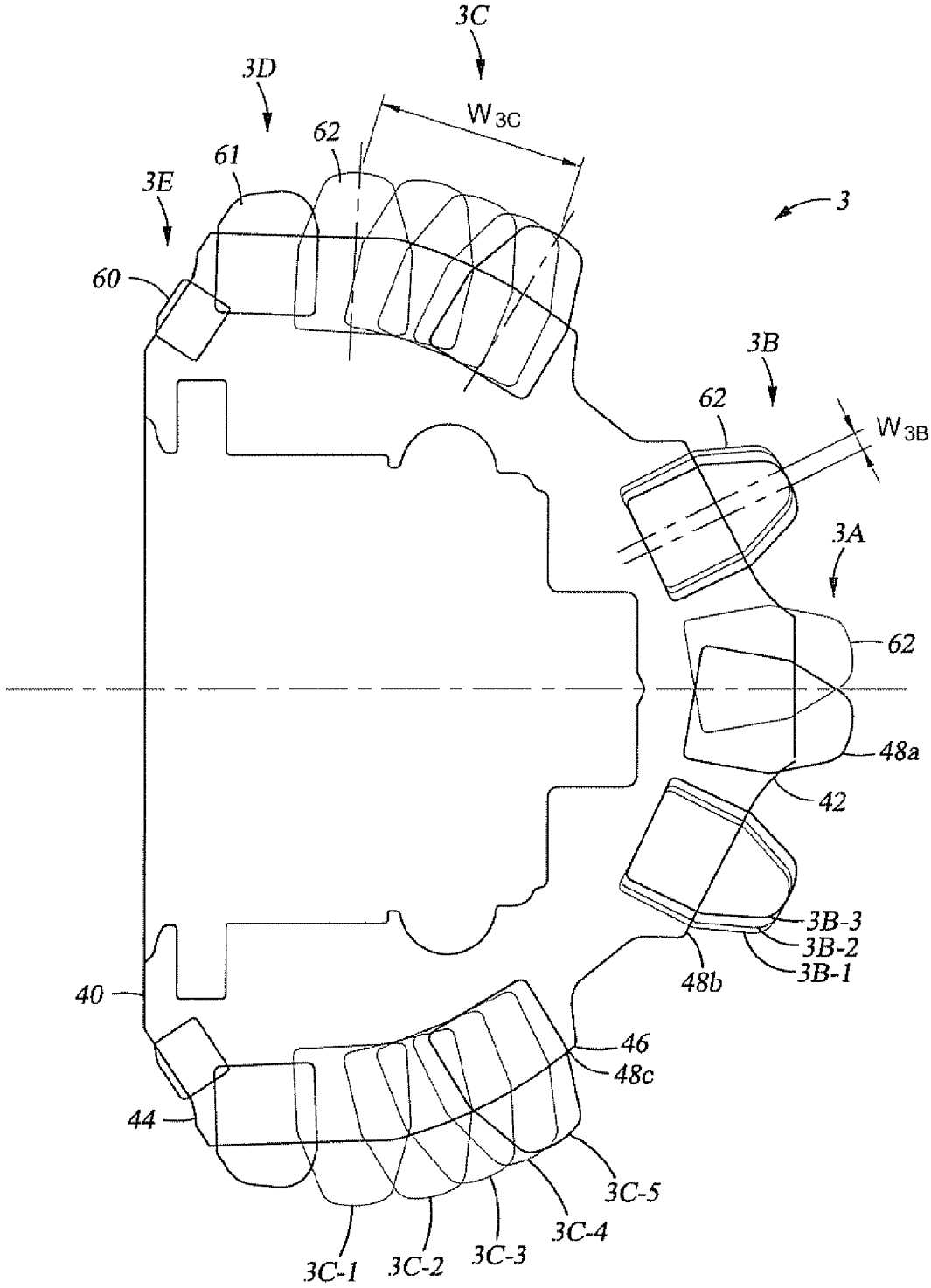
FIG. 8 is a schematic view showing, in rotated profile, the cutting profiles of the cutter elements disposed in the cone cutter shown in FIG. 7A.

Referring to FIG. 8, the twenty-seven bottom hole cutter elements 62 of cone 3 are positioned in one of nine unique radial positions. Specifically, the six bottom hole cutter elements 62 of array 3B (cutter elements 3B-1 through 3B-6) are positioned in one of three differing radial positions. Further, the twenty bottom hole cutter elements 62 of array 3C (cutter elements 3C-1 through 3C-20) are positioned in one of five differing radial positions that each differ from the radial positions of bottom hole cutter elements 62 of array 3B. Still further; the single bottom hole cutter element 62 of group 3A occupies a radial position differing from each of the radial positions of bottom hole cutter elements 62 of array 3B and array 3C. Therefore, the ratio of unique radial positions for bottom hole cutter elements 62 to the total number of bottom hole cutter elements 62 of cone 3 is about 0.33, or 33% (i.e., 9 radial positions divided by 27 total bottom hole cutter elements). Stated differently, cone 3 may be described as including a total number $X_3$ of bottom hole cutter elements 62, twenty-seven total bottom hole cutter elements 62 in this embodiment (i.e., $X_3$ is twenty-seven), positioned in one of $Y_3$ different radial positions, nine different radial positions for bottom hole cutter elements 62 in this embodiment (i.e., $Y_3$ is nine), where the ratio of $Y_3$ to $X_3$ is about 0.33, or 33%, in this embodiment.

Regarding array 3B, cutter elements 3B-1 through 33-6 of array 3B, cutter elements 3B-1 and 3B-4 share the same radial position and are positioned closest to heel surface 44 and furthest from bit axis 11 (i.e., outermost cutter elements of array 3B). Cutter elements 3B-3 and 3B-6 share the same radial position and are positioned closest to bit axis 11 and furthest from heel surface 44 (i.e., innermost cutter elements of array 3B). Remaining cutter elements 3B-2 and 3B-5 share the same radial position and are positioned between the innermost cutter elements and outermost cutter elements of array 3B. In this arrangement, cutter elements 33-1 through 3B-3 and cutter elements 3B-4 through 3B-6 each form a spiral arrangement, respectively, within array 3B. Thus, array 3B may be described as including two spiral arrangements, each spiral arrangement including three cutter elements in differing radial positions.

Regarding array 3C, cutter elements 3C-1, 3C-6, 3C-11, and 3C-16 share the same radial position and are positioned closest to heel surface 44 and furthest from bit axis 11 (i.e., outermost cutter elements of array 3C). Cutter elements 3C-5, 3C-10, 3C-15, and 3C-20 share the same radial position and are positioned closest to bit axis 11 and furthest from heel surface 44 (i.e., innermost cutter elements of array 3C). Cutter elements 3C-2, 3C-7, 3C-12, and 3C-17 share the same radial position, cutter elements 3C-3, 3C-8, 3C-13, and 3C-18 share the same radial position, cutter elements 3C-4, 3C-9, 3C-14, and 3C-19 share the same radial position, and are generally positioned between the innermost cutter elements and outermost cutter elements of array 3C. In this arrangement, cutter elements 3C-1 through 3C-5, cutter elements 3C-6 through 3C-10, cutter elements 3C-11 through 3C-15, and cutter elements 3C-16 through 3C-20 each form a spiral arrangement, respectively, within array 3C. Thus, array 3C may be described as including four spiral arrangements, each spiral arrangement including five cutter elements in differing radial positions. Relative to the direction of cone rotation 80, the spiral arrangement of cutter elements 3B-1 through 3B-6 in array 3B spirals in the same direction as spiral arrangement of cutter elements 3C-1 through 3C-20 in array 3C. Still referring to FIG. 8, the rotated profile view of array 3B, represented by die overlapping cutting profiles of cutter elements 3B-1 through 3B-6, has a width $W_{3B}$ measured as previously described. In this embodiment, width $W_{3B}$ is about 20% of diameter D of any cutter element within array 3B. Further, the rotated profile view of array 3C, represented by the overlapping cutting profiles of cutter elements 3C-1 through 3C-20, has a width $W_{3C}$ measured as previously described. In this embodiment, $W_{3C}$ is about 150% of diameter D of any cutter element within array 3C.

As best seen in FIG. 8, as cone 3 rotates in the borehole, cutter elements 3B-1 through 3B-6 of array 3B will cut substantially the entire width $W_{3B}$ of the adjacent formation. Specifically, cutter elements 3B-1 through 3B-6 of array 3B are sufficiently sized and positioned relatively close to each other (i.e., the distance Z between adjacent cutter elements of array 2B is relatively small) such that, in rotated profile, the formation and size of cutting voids or ridges of uncut formation between the individual cutter elements 3B-1 through 3B-6 of array 3B is reduced or substantially eliminated. Likewise, as cone 3 rotates in the borehole, cutter elements 3C-1 through 3C-20 of array 3C will cut substantially the entire width $W_{3C}$ of the adjacent formation. As with the cutter elements of array 3B, the, cutter elements 3C-1 through 3C-20 of array 3C are sufficiently sized and positioned such that, in rotated profile, the formation and size of cutting voids or ridges of uncut formation are between the individual cutter elements 3C-1 through 3C-20 of array 3C is reduced or substantially eliminated.

By reducing the formation and size of ridges of uncut formation between the individual cutter elements within arrays 3B, 3C, arrays 3B, 3C each offer the potential to increase bottom hole coverage while reducing the likelihood of undesirable wear and damage to cone 3 and the cutter elements of cone 2 resulting from contact with relatively large segments of uncut formation.

In addition, by offsetting, staggering, and/or, fanning out cutter elements 3B-1 through 3B-6 of array 3B and cutter elements 3C-1 though 3C-20 of array 3C (e.g., by positioning cutter elements 3B-1 through 3B-6 and cutter elements 3C-1 through 3C-20, respectively, in a plurality of differing radial positions), the likelihood that the cutting tip of a cutter element within array 3B, 3C will fall entirely within a crater or indentation previously-formed by another cutter element of array 3B, 3C, respectively, is lessened, thereby offering the potential for reduced bit tracking as compared to a conventional circumferential row of cutter elements that tend to sweep along substantially the same paths. Further, by offsetting, staggering, and/or fanning out cutter elements 3B-1 through 3B-6 and cutter elements 3C-1 through 3C-20, overall bottom hole coverage by cutter elements 3B-1 through 3B-6 and 3C-1 through 3C-20 can be increased as compared to a conventional circumferential low of cutter elements. By offsetting, staggering, and/or fanning out cutter elements 3B-1 through 3B-6 of array 3B and cutter elements 3C-1 through 3C-20 of array 3C, while at the same time sufficiently sizing and positioning cutter elements 3B-1 through 3B-6 of array 3B and cutter elements 3C-1 through 3C-20 of array 3C, arrays 3B, 3C each offer the potential for the following benefits—reduced formation and size of uncut ridges of formation, reduced likelihood of excessive wear and damage to cone 3 and the cutter elements of cone 3, reduced likelihood for bit tracking, increased bottom hole coverage as compared to a conventional circumferential row of cutter elements, and increased drilling life for the bit. One or more of these desirable benefits of arrays 3B, 3C may also increase the ROP of bit 10 as it drills through formation.

Referring now to FIG. 9, array 1B of cone 1 intermeshes with cone 2 between array 2B and row 2A, and intermeshes with cone 3 between array 3B and array 3C. Further, array 2B of cone 2 intermeshed with cone 1 between array 1B and array 1C, and intermeshes with cone 3 between array 3B and array 3C. Still further, array 3B of cone 3 intermeshes with cone 1 between group 1A and array 1B, and intermeshes with cone 2 between row 2A and array 2B. Array 3C of cone 3 also intermeshes with cone 1 and cone 2. Specifically array 3C intermeshes with cone 1 between array 1B and array 1C, and intermeshes with cone 2 between array 2B and array 2C. Thus, cone 1 has two arrays at least partially in intermesh region 70 (array 1B and a portion of array 1C), and one array partially in non-intermesh region 72 (remaining portion of array 1C). Cone 2 has one array in intermesh region 70 (array 2B), and one array in non-intermesh region 72 (array 2C). Lastly, cone 3 has two arrays in intermesh region 70 (array 31 and array 3C). Within intermesh region 70, substantial bottom hole coverage is provided by rows 1A, 2A, 3A and by arrays 1B, 2B, 3B, and portions of 3C, previously described. In non-intermeshed region 72, outside or radially distant from the intermeshed region 70, substantial bottomhole coverage is provided by arrays 1C, 2C, and portions of array 3C. Gage rows 1D, 2D, and 3D generally cut the corner 6 of the borehole, and thus cut a portion of sidewall 5 and bottomhole 7. Further, heel rows 1E, 2E, and 3E ream the borehole sidewall 5.

Figure 10:
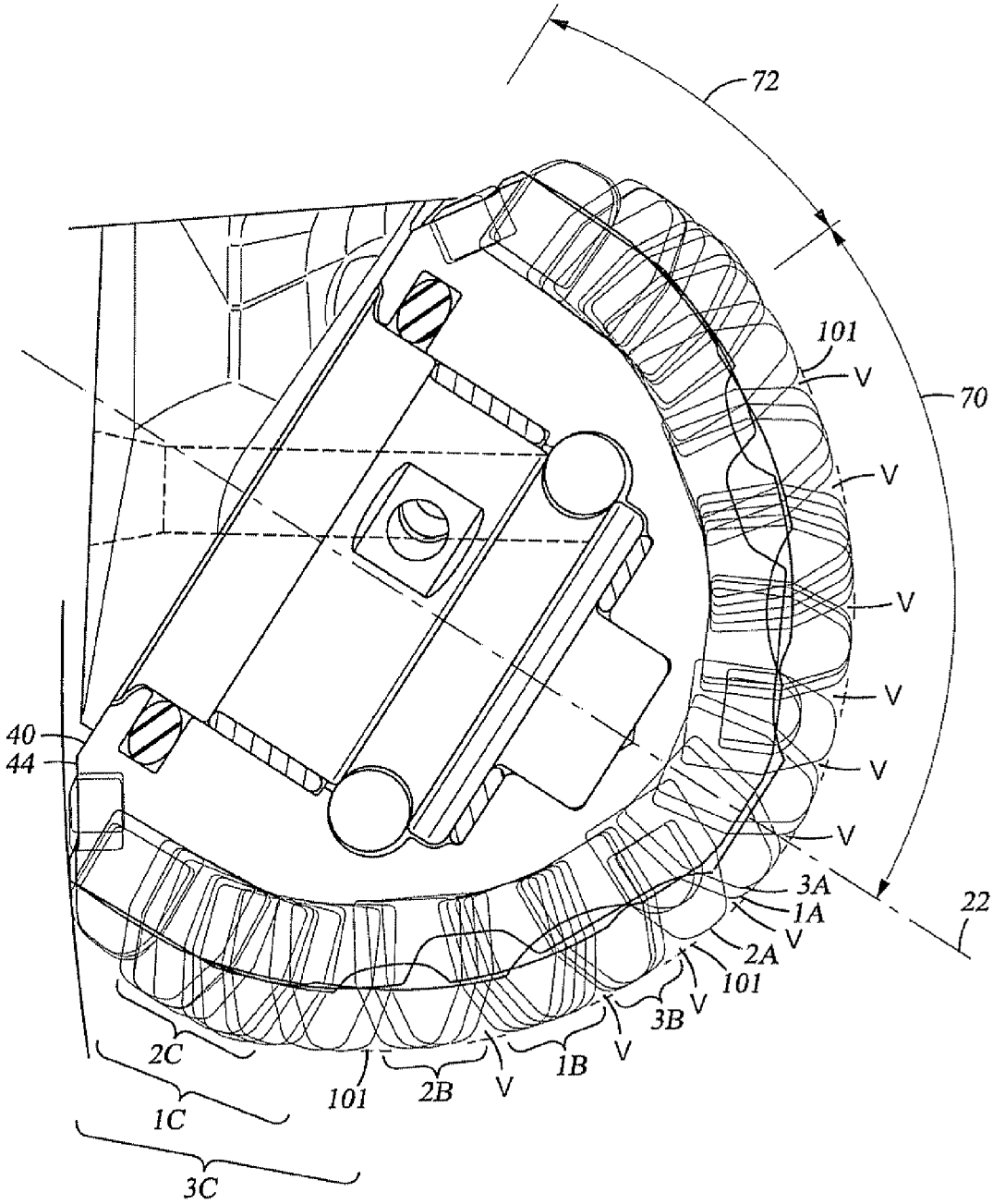
FIG. 10 is a partial view showing, schematically and in rotated profile, the cutting profiles of all of the cutter elements of the three cone cutters of the drill bit shown in FIG. 1.

Referring to FIG. 10, the cutting surfaces, and hence cutting profiles, of each of the cutter elements of all three cones 1-3 are shown rotated into a single profile termed herein the "composite rotated profile view." In the composite rotated profile view, the overlap of cutter elements within an array or row is shown, as well as the overlap of different rows and arrays that are positioned on different cones. Consequently, the composite rotated profile view illustrated in FIG. 10 shows the borehole coverage of the entire bit 10. Within intermesh region 70 of this exemplary embodiment, array 2B is generally positioned between array 3C and array 1B, array 1B is positioned between array 2B and array 3B, and array 3B is positioned between array 1B and nose row 2A. Each array within intermesh region 70 is generally positioned between two arrays, or between an array and a row, provided on adjacent cones, thereby permitting sufficient clearance for the cutting surfaces of cutter elements on adjacent cones that intermesh.

Referring still to FIG. 10, although each array is generally positioned between two other arrays, or between an array and a row, the cutting profiles of adjacent arrays and rows on different cones partially overlap within intermesh region 70 when viewed in composite rotated profile. Such partial overlapping of adjacent arrays and rows in composite rotated profile view is permitted without detrimentally affecting clearance provided between the cutter elements of adjacent cones as best seen in FIG. 9.

Referring still to FIG. 10, as a result of the positioning and arrangement of arrays and rows within intermesh region 70 as described above, when viewed in composite rotated profile, ridges of uncut formation or cutting voids V may form between adjacent arrays of cutter elements within intermesh region 70, and between adjacent arrays and rows of cutter elements within intermesh region 70. However, the partial overlapping and relatively close positioning, in composite rotated profile, of the adjacent arrays and rows within intermesh region 70 reduces the size of cutting voids V that form therebetween, thereby offering the potential for increased bottom hole coverage, while reducing the likelihood of undesirable wear and damage to cones 1-3 and the cutter elements of cones 1-3.

Figure 11:
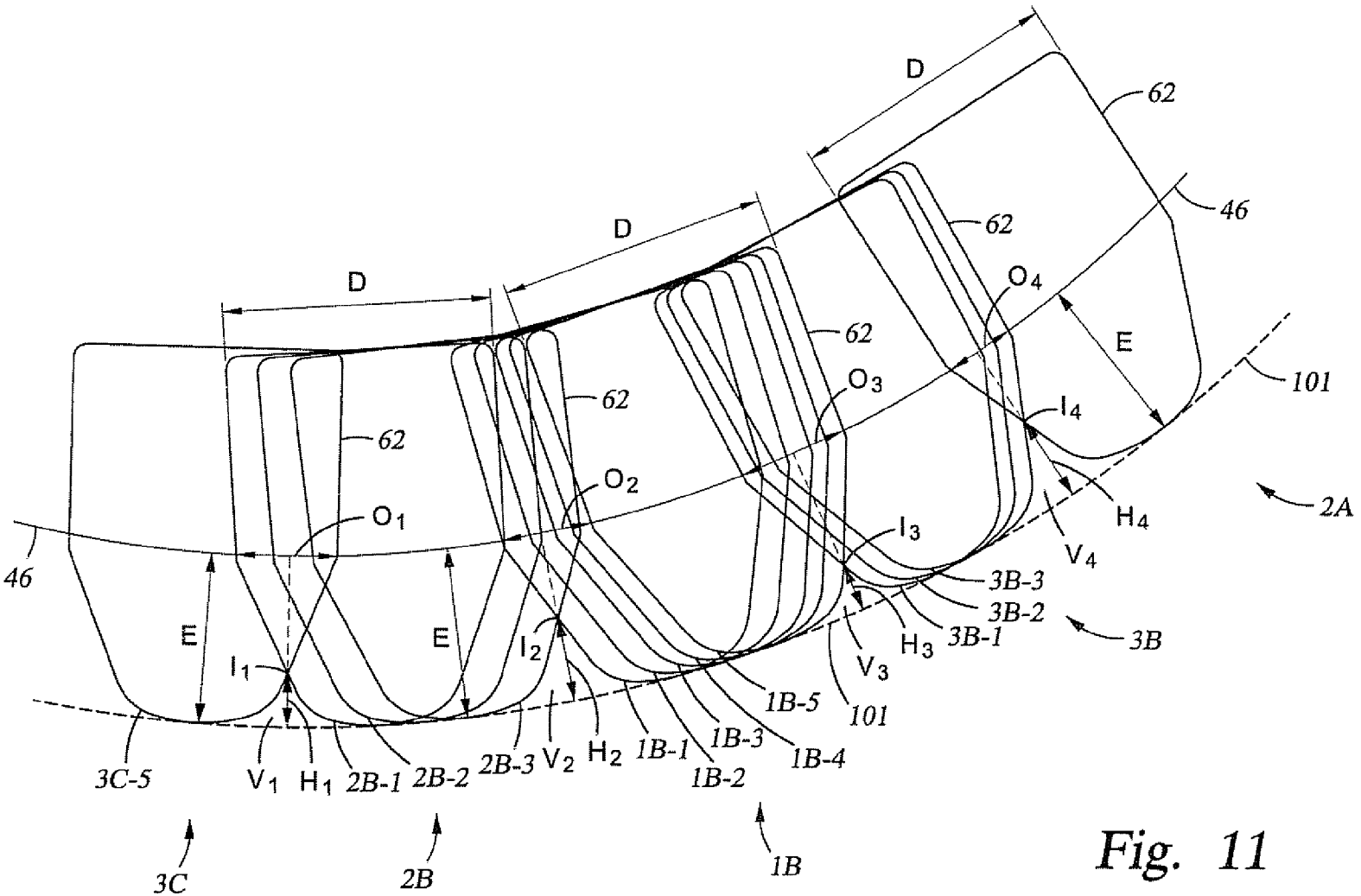
FIG. 11 is a partial enlarged schematic view showing, in rotated profile, the cutting profiles of selected cutter elements of the three cone cutters of the drill bit shown in FIG. 1.

Referring now to FIG. 11, in composite rotated profile view, the cutting profile of each array overlaps with the cutting profile of an adjacent array or row at a point of intersection I. Specifically, the cutting profile of array 3C intersects the cutting profile of array 2B at intersection $I_1$, the cutting profile of array 2B intersects the cutting profile of array 1B at intersection $I_2$, the cutting profile of array 1B intersects the cutting profile of array 3B at intersection $I_3$, the cutting profile of array 3B intersects the cutting profile of row 2A at intersection $I_4$. Further, the cutter element with the greatest extension height within each array or row defines an envelope for that array or row. In the embodiment shown in FIG. 11, each cutter element 62 has substantially the same extension height and thus arrays 3C, 2B, 1B, 3B, and row 2A share the same envelope 101. As a result of the partial overlap of cutting profiles of adjacent arrays and/or rows, a cutting void $V_1$ forms between array 3C and array 2B, a cutting void $V_2$ forms between array 2B and array 1B, a cutting void $V_3$ forms between array 1B and array 3B, and a cutting void $V_4$ forms between array 3B and row 2A. Each cutting void $V_1$ through $V_4$ has a depth or height $H_1$ through $H_4$, measured perpendicular to the cone surface from envelope 101 to point of intersection $I_1$ through $I_4$, respectively. Thus, height $H_1$ of cutting void $V_1$ is the distance perpendicular to cone surface 46 measured from envelope 101 defined by the extension height E of any of cutter element in array 3C or 2B to point of intersection $I_1$ of array 3C and array 2B. Similarly, height $H_2$ of cutting void $V_2$ is the distance perpendicular to cone surface 46 measured from envelope 101 defined by the extension height E of any cutter element in array 2B or array 1B to point of intersection $I_2$ of array 2B and array 1B.

In the exemplary embodiment illustrated in FIG. 11, height $H_1$ of cutting void $V_1$ is about 25% of the extension height E, and height $H_2$ of cutting void $V_2$ is about 45% of extension height E. In contrast, conventional rolling cone bits that employ circumferential rows of cutter elements within the intermesh region, may yield cutting voids or ridges of uncut formation between the cutting profiles of adjacent rows in composite rotated profile that are significantly greater than the cutting voids formed by embodiments of bit 10 described herein. For instance, in some conventional rolling cone bits, the height of a cutting void or ridge of uncut formation may approach 100% of the extension height of any cutter element on the bit. In other words, in some conventional rolling cone bits, the cutting voids or ridges of uncut formation between cutter cutting profiles of adjacent rows of cutter elements in composite rotated profile may extend completely from the cone surface to the extension height of a cutter element.

By reducing the height H of cutting voids V between adjacent arrays and/or rows of cutter elements, embodiments described herein offer the potential for enhanced bottom hole coverage and reduced wear on the cutter elements and cones. In one or more embodiments, the height H of each cutting void V, as viewed in composite rotated profile, is preferably less than 75% of the extension height E of any cutter element on the bit, and more preferably less than 50% of the extension height E of any cutter element on the bit.

Referring again to FIG. 10, the six cutter elements 62 of array 3B collectively define the rotated profile of array 3B. Likewise, the ten cutter elements 62 of array 1B define the rotated profile of array 1B, the twelve cutter elements 62 of array 2B define the rotated profile of array 2B, and the twenty cutter elements 62 of array 3C define the rotated profile of array 3C. Further, the one cutter element 62 of group 1A defines the rotated profile of group 1A, the two cutter elements 62 of row 2A define the rotated profile of row 2A, and the one cutter element 62 of group 3A defines the rotated profile of group 3A. In this embodiment, it is evident that a substantial number of inner row cutter elements 62 (fifty-eight in this exemplary embodiment) are available for bottomhole cutting in the region immediately adjacent to gage cutter elements 61. Further, given the overlap of cutter elements 62 within each array 1B, 2B, 3B, and 3C as previously described, as well as the overlap between the cutting profiles of adjacent arrays 3B and 1B, adjacent arrays 1B and 2B, and adjacent arrays 2B and 3C in composite rotated profile view, cutter elements 62 of cones 1-3 substantially cover borehole bottom 7. As a result, a relatively small amount of uncut borehole bottom 7 exists and few relatively small cutting voids or ridges of uncut formation will be formed between cutter elements 62 within an given array (e.g., between cutter elements 1B-1 through 1B-10 of array 1B), and between cutting profiles of adjacent arrays and/or rows in composite rotated profile (e.g., between array 1B and array 2B). In some embodiments, the spacing of cutter elements 62 within an array and the spacing of arrays and rows on adjacent cones may be such that the combined rotated profile view is substantially free of cutting voids V. In such embodiments, the combined rotated profile may therefore be described as free of cutting voids.

Referring again to FIG. 11 and as previously described, in composite rotated profile view, each array and row in intermesh region 70 overlaps with one or more arrays or rows of an adjacent cone. For instance, array 3B of cone 3 overlaps with row 2A of cone 2 and array 1B of cone 1, array 1B of cone 1 overlaps with array 3B of cone 3 and array 2B of cone 2, and array 2B of cone 2 overlaps with array 3C of cone 3 and array 1B of cone 1. The degree of overlap may be assessed by determining the ratio of the amount of overlap O of overlapping adjacent arrays or rows at the cone surface in composite rotated profile view to the diameter D of a cutter element in either of the overlapping arrays or rows, termed herein as the "overlap ratio." Arrays 3C and 2B overlap by an amount of overlap $O_1$, arrays 2B and 1B overlap by an amount of overlap $O_2$, arrays 1B and 3B overlap by an amount of overlap $O_3$, and array 3B overlaps with row 2A by an amount of overlap $O_4$. In the embodiment illustrated in FIG. 11, the ratio of overlap $O_1$ to diameter D is about 40%, and the ratio of overlap $O_2$ to diameter D is about 38%. In general, with a given cutter element shape and geometry, the greater the overlap ratio between adjacent arrays/rows in composite rotated profile view, the smaller the height H of cutting voids V of uncut formation. Thus, the overlap ratio between adjacent arrays/rows in composite rotated profile to diameter D of any cutter element within the overlapping arrays/rows is preferably greater than 10%, and more preferably greater than 25%. For instance, in some embodiments the overlap ration between adjacent arrays/rows in composite rotated profile to diameter D of any cutter element within the overlapping arrays/rows is greater than 40%.

In the exemplary embodiment shown in FIGS. 10 and 11, the composite rotated profile view has few relatively small cutting voids between nose 42 and heel surface 44, including intermeshed region 70 and non-intermeshed region 72, thereby reducing the tendency for bit 10 to track, increasing bottomhole coverage, and reducing the likelihood of excessive wear on the cutter elements and/or cone. In other embodiments, the composite rotated profile view may be substantially flee of cutting voids between nose 42 and heel surface 44, potentially reducing the tendency of bit 10 to track even further.

In addition to offering the potential to reduce bit tracking, employing arrays of bottomhole cutter elements 62 having differing radial positions may enable the use of larger more robust gage cutter elements 61. As can further be understood with reference to FIGS. 4A, 6, and 8, a rolling cone may be designed with more or less space available for the gage row cutter elements 61 depending, in part, on the spacing of the radially-outermost array of bottomhole cutter elements 62 (i.e., array of bottom hole cutter elements 62 adjacent gage cutter elements 61). For instance, if array 2C of cone 2 is positioned further from gage row 2D and closer to cone axis 22, or if the cutter elements 61 in gage row 2D are instead arranged as an array, then greater room will be afforded gage cutter elements 61 of gage row 2D. Increased space for gage cutter elements 61 enables the use of gage cutter elements 61 having larger diameters. Thus, in addition to anti-tracking potential, by providing gage inserts of larger diameter, some embodiments of cones 1-3 may be more robust and durable in their corner cutting capabilities, as compared to a cone cutter in which all of the gage row cutter elements are of a single, smaller diameter.

Further, the increased latitude for the positioning of gage cutter elements 61 may enable the use of gage cutter elements 61 having different extension heights, different or more desirable cutting shapes, or be made with a different materials or material enhancements. Similarly, varying the width and degree of overlap between the gage cutter elements 61 on a cone and the nearest array of bottomhole cutter elements 62 on the same cone provides the bit designer with more latitude in the positioning of gage cutter elements 61 relative to the borehole sidewall 5 (e.g., engaging either higher or lower on the hole wall) and in the number of gage cutter elements 61 that may be employed on the cone. For instance, in some embodiments, gage cutter elements 61 of one or more cones 1-3 may also be arranged in an array. In a corresponding manner, the size, number, diameter, extension, shape and materials of the heel row cutter elements may likewise be varied on a single cone, and from cone to cone, depending upon the size, arrangement, and composite cutting profile of the gage row cutter elements.

Although the embodiment of bit 10 illustrated in FIG. 1 includes three cone cutters 1-3, it should be appreciated that in different embodiments, arrays of cutter elements (e.g., offset, staggered, fanned out, or spiraled arrangements of cutter elements), as described herein may also be employed in rolling cone bits having one, two, three, or more cone cutters to provide enhanced bottom hole coverage, reduced bit tracking, reduction in the formation of uncut ridges of formation, increased ROP, reduced cone damage and wear, and increased bit life. In addition, in the exemplary embodiments described herein, two arrays are illustrated on each cone cutter (e.g., cone 1). However, it should be appreciated that in other embodiments, one or more of the desired benefits may be achieved by including one or more array(s) on select cone cutter(s) of a rolling cone bit and no arrays on other cone cutter(s). For instance, in an embodiment of a three cone drill bit a first cone may have no arrays, a second cone may have one array, and a third cone may have two arrays.

Although arrays 1B, 1C, 2B, 2C, 3B, and 3C have been depicted and described as spirals in the exemplary embodiments presented, other arrangements (e.g., staggered, fanned, or random arrangements of cutter elements) may be employed to achieve one or more desired benefits. More particularly, and referring, for example, to FIG. 4A, the same number of cutter elements 62 may be employed in frustoconical region 48*b* and be positioned so that their cutting surfaces, in rotated profile, cover at least width W without the cutter elements being positioned in a spiral. For example, cutter elements 1B-1 through 1B-10 may each be disposed at a unique radial position so that, in rotated profile, the entire width W is covered. As a specific example; instead of arranging cutter elements 1B-1 through 1B-10 in two separate spirals as shown, those cutter elements 62 in array 1B may be randomly positioned about surface 48*b* so that cutter elements 62 within array 1B do not progress in a spiral fashion, but still create the same composite cutting profile shown in FIG. 4A. Alternatively, instead of arranging cutter elements 62 of array 1B into two separate spirals, pairs of cutter elements 62 having the same radial position could be positioned adjacent to one another so that, upon moving about the cone axis 22 along frustoconical surface 48*b*, there would first be two cutter elements 62 having the same innermost radial position, followed by two cutter elements 62 having the next innermost radial position, and so on. Numerous other, arrangements are possible.

Further characteristics and properties of the cutter elements of an array may be varied depending upon the application. In general, it may be desirable for cutter elements further from gage and intended to have a substantial share of the bottomhole cutting duty be provided with a greater extension height than cutter elements positioned closer to gage. Thus, referring to FIG. 3A as an example, it may be desirable that cutter elements 1C-3, 1C-6, 1C-9, 1C-12, and 1C-15 have greater diameters and/or greater extension heights, compared to the cutter elements 1C-1, 1C-4, 1C-7, 1C-10, and 1C-13. Likewise, the shape of the cutter elements in an array may differ. Once again referring to FIG. 3A as an example, it may be desirable that the cutter element 1C-3, 1C-6, 1C-9, 1C-12, and 1C-15 have an aggressive chisel shape, for example, while the cutter element closer to gage, cutter elements 1C-1, 1C-4, 1C-7, 1C-10, and 1C-13, may have a hemispherical cutting surface or a generally flat cutting surface. Moreover, individual cutter elements within an array may have varying extension heights. For instance, extension heights of the cutter elements in the array may be increased towards the middle of the array for enhanced aggression. Referring to FIG. 4A as an example, it may be desirable that cutter element 1B-3 have a greater extension height than cutter elements 1B-2 and 1B-4, and that cutter elements 1B-2 and 1B-4 have greater extension heights than cutter elements 1B-1 and 1B-5. In summary, the cutter elements in a non-circumferentially arranged array may differ substantially with regards to insert diameter, extension height, shape of the cutting surface, twist angle, material grades, material types, material coatings, or combinations thereof.

In the foregoing examples, the arrays of cutter elements disposed in the intermesh region 70 and non-intermesh region 72 of each cone cutter with cutting elements positioned in a plurality of differing radial positions are intended to prevent the cutter elements from falling within previously-made indentations so as to lessen the likelihood of bit tracking. In general, the larger the cone diameter in the region in which the array of elements is to be placed, the greater the number of different radial positions that can be employed.

In the embodiments described above, the arrays of cutter element arrays extend generally from a nose group or row of cutter elements (e.g., group 1A) to a gage row of cutter elements (e.g., gage row 1D) that is generally adjacent heel surface 44. However, these arrays of offset cutter elements may continue outwardly so as to encompass the gage region and even the heel region. For example, circumferential row 1E of heel cutter elements 60 of cone 1 may be replaced by an array of heel cutter elements 60. Such an embodiment of cone 1 would then include three arrays of cutter elements, each mounted in axially spaced apart bands. U.S. patent application Ser. No. 11/203,863 filed Aug. 15, 2005, which is hereby incorporated herein by reference in its entirety, describes arrays of gage cutter elements and arrays of heel cutter elements on rolling cone cutters.

Figure 12:
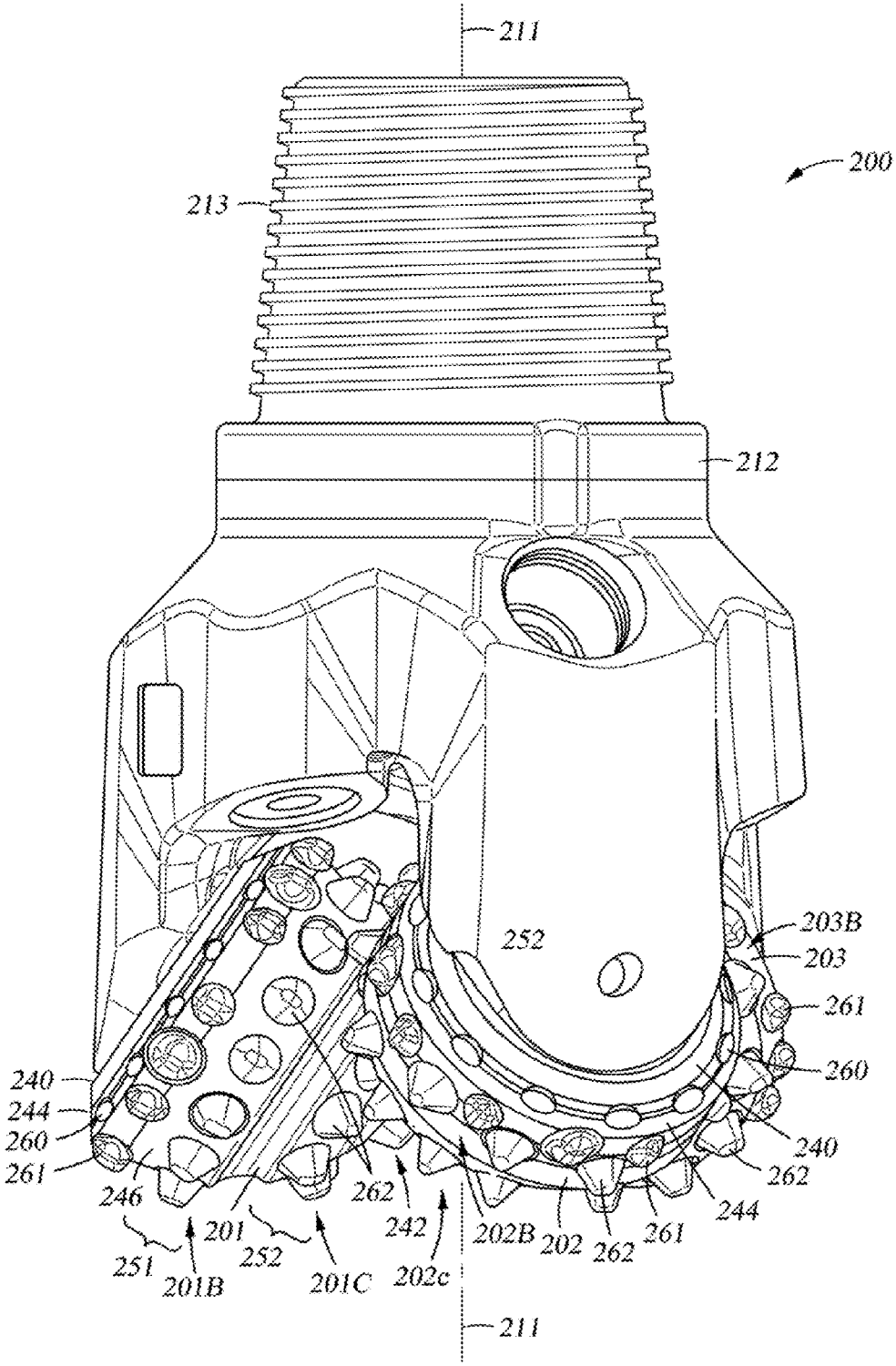
FIG. 12 is a perspective view of an embodiment of an earth-boring bit made in accordance with the principles described herein.

Referring now to FIG. 12, an earth-boring bit 200 is shown to include a central axis 211 and a bit body 212 having a threaded section 213 at its upper end that is adapted for securing the bit to a drill string (not shown). Bit 200 is similar to bit 10 previously described. Namely, bit 200 includes three rolling cone cutters 201, 202, 203 which are rotatably mounted on bearing shafts that depend from the bit body 212. Each cutter 201-203 includes a generally planar backface 240 and nose 242 generally opposite backface 240. Adjacent to backface 240, cutters 201-203 further include a generally frustoconical surface 244 that is adapted to retain cutter elements that scrape or ream the sidewalls of the borehole. Extending between heel surface 244 and nose 242 is a generally conical cone surface 246 adapted for supporting cutter elements that gouge or crush the borehole bottom. The cutter elements of cones 201-203 intermesh with the cutter elements of the adjacent cones 201-203. Further, each cone 201-203 includes a circumferential row of heel cutter elements 260, a circumferential row of gage cutter elements 261, a first array 201B, 202B, 2038, respectively, of bottomhole cutter elements 262 arranged in a first band 251 and mounted in a plurality of different radial positions, and a second array 201C, 202C, 203C, respectively, of bottomhole cutter elements 262 arranged in a second band 252 that is axially spaced apart from first band 251 and mounted in a plurality of different radial positions. However, unlike bit 10 previously described, in this embodiment, each bottomhole cutter element 262 in each array 201B, 202B, 203B, 201C, 202C, 203C is disposed in a unique radial position.

Bits having arrays of cutter elements positioned in a plurality of differing radial positions on one or more cones offer the potential for increased bottom hole coverage, reduced formation and size of ridges of uncut formation, reduced wear and/or damage to the cutter elements and cones, reduced likelihood for, bit tracking, increased ROP, and/or increased bit life. As previously described, by arranging cutter elements in an array, the formation and size of cutting voids or ridges of uncut formation between the individual cutter elements of the array are reduced. Further, since the cutting profiles of the arrays of adjacent cones do not share the same radial positions, arrays on adjacent cones can be intermeshed to reduce and/or eliminate large uncut regions of formation between paths cut by different arrays on adjacent cones.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A drill bit for drilling through earthen formations and forming a borehole, the bit comprising:

a bit body having a bit axis;

a plurality of cone cutters, each of the cone cutters being mounted on the bit body and adapted for rotation about a different cone axis;

wherein each cone cutter on the bit comprises a first array of bottomhole cutter elements mounted in a first band and a second array of bottomhole cutter elements mounted in a second band that is axially spaced apart from the first band relative to the cone axis in rotated profile view;

wherein the cutter elements in each array are mounted in a plurality of differing radial positions relative to the bit axis:

wherein each cone cutter further comprises a backface, a nose opposite the backface, a non-intermesh region adjacent to the backface, and an intermesh region between the non-intermesh region and the nose; and wherein at least one array is mounted within the intermesh region.

2. The drill bit of claim 1 wherein each cutter element within the first band and each cutter element in the second band is positioned in the cone to cut a bottom of the borehole.

3. The drill bit of claim 1 wherein at least one cone cutter includes a third array of cutter elements mounted in a third band axially spaced apart from the first band and the second band.

4. The drill bit of claim 1 wherein the cutter elements mounted on the plurality of cone cutters form a composite cutting profile when the plurality of cone cutters are rotated into a single plane, wherein each array at least partially overlaps with at least one other array on an adjacent cone in the composite cutting profile.

5. The drill bit of claim 4 wherein each cutter element has a base diameter and wherein each array overlaps with at least one other array on an adjacent cone by at least 10% of the base diameter of any cutter element within either of the overlapping arrays in composite rotated profile.

6. The drill bit of claim 4 wherein each cutter element has an extension height and wherein the composite cutting profile includes one or more cutting voids, wherein each cutting void has a height less than 75% of the extension height of any cutter element.

7. The drill bit of claim 6 wherein each cutting void is less than 50% of the extension height of any cutter element.

8. The drill bit of claim 1 wherein the cutter elements mounted on the plurality of cone cutters form a composite cutting profile when the plurality of cone cutters are rotated into a single plane, wherein the composite cutting profile includes an intermesh region, the intermesh region including one or more cutting voids less than 75% of an extension height of any cutter element.

9. The drill bit of claim 8 wherein each cutting void in the intermesh region is less than 50% of the extension height of any cutter element.

10. The drill bit of claim 1 wherein the cutter elements of each array form a cutting profile when rotated into a single plane, wherein each cutter element has a central axis, and wherein the cutting profile of each array includes at least two cutter elements having axes skewed relative to one another.

11. The drill bit of claim 1 wherein the cutter elements of each array form a cutting profile when rotated into a single plane, wherein each cutter element has a central axis, and wherein the axes of adjacent cutter elements in the cutting profile of each array are skewed relative to one another.

12. The drill bit of claim 1 wherein at least one cutter element in the first array differs from another cutter element in the first array by a characteristic selected from the group consisting of diameter, extension height, cutting surface shape, twist angle, and material composition.

13. The drill bit of claim 1 wherein each array comprises N cutter elements disposed in at least P differing radial positions, where P is at least three.

14. The drill bit of claim 13 wherein P is at least four.

15. The drill bit of claim 1 wherein at least one first array of cutter elements includes a first set of $N_1$ cutter elements disposed in $P_1$ differing radial positions and a second set of $N_2$ cutter elements disposed in $P_2$ radial positions relative to the bit axis;

wherein the $P_1$ differing radial positions each differ from the $P_2$ differing radial positions.

16. The drill bit of claim 1 wherein each cutter element in each array is disposed in a different radial position.

17. A drill bit for drilling through earthen formations and forming a borehole, the bit comprising:

a bit body having a bit axis;

at least two rolling cone cutters mounted on the bit body and adapted for rotation about a cone axis;

wherein each cone cutter includes a plurality of cutter elements, a backface, a nose opposite the backface, a non-intermesh region adjacent the backface, an intermesh region between the non-intermesh region and the nose:

an array of cutter elements mounted in a plurality of differing radial positions within a band on at least one of the cone cutters, wherein the array of cutter elements is positioned within the intermesh region;

wherein each cutter element has a diameter, a central axis, and a crest;

wherein the cutter elements of the array form a cutting profile when rotated into a single plane, wherein the cutting profile of the array includes at least two cutter elements spaced apart by a distance measured between the axes of the two cutter elements at crest of the two cutter elements that is at least 50% of the diameter of any cutter element within the array.

18. The drill bit of claim 17 wherein the distance is at least 60% of the diameter of any cutter element within the array.

19. The drill bit of claim 18 comprising at least two rolling cone cutters mounted on the bit body and adapted for rotation about a cone axis, wherein each cone cutter includes a plurality of cutter elements, a backface, a nose opposite the backface, a non-intermesh region adjacent the backface, an intermesh region between the non-intermesh region and the nose, wherein the array of cutter elements is positioned within the non-intermesh region.

20. The drill bit of claim 17 wherein the distance is at least 75% of the diameter of any cutter element within the array.

21. The drill bit of claim 17 wherein the distance is at least equal to the diameter of any cutter element within the array.

22. The drill bit of claim 17 wherein the array comprise N cutter elements disposed in at least P differing radial positions, where P is at least three.

23. The drill bit of claim 22 where P is at least four.

24. The drill bit of claim 17 wherein the cutting profile of the array includes at least two cutter elements whose axes are skewed relative to one another.

25. The drill bit of claim 17 wherein a first cutter element in the array differs from a second cutter element in the array by a characteristic selected from the group consisting of diameter, extension height, cutting surface shape, twist angle, and material composition.

26. A drill bit for creating a borehole in earthen formations, comprising:

a bit body having a bit axis;

a plurality of cone cutters, wherein each of the cone cutters is mounted on the bit body and adapted for rotation about a different cone axis and includes an intermesh region;

wherein each cone cutter includes at least one array of cutter elements mounted in a plurality of differing radial positions within a band in the intermesh region, wherein each cutter element has an extension height;

wherein the cutter elements of each array form a cutting profile when rotated into a single plane;

wherein the cutter elements mounted on the plurality of cones form a composite cutting profile when the plurality of cones are rotated into a single plane, the composite cutting profile including an intermesh region;

wherein the cutting profile of each array in the composite cutting profile at least partially overlaps with the cutting profile of another array on an adjacent cone;

wherein the composite cutting profile includes a plurality of cutting voids; and wherein each cutting void within the intermesh region of the composite cutting profile has a depth less than 75% of the extension height of any cutter element in the intermesh region of the composite cutting profile.

27. The drill bit of claim 26 wherein the cutter elements in each array are mounted in at least three differing radial positions.

28. The drill bit of claim 27 wherein the cutter elements in each array are mounted in at least four differing radial positions.

29. The drill bit of claim 26 wherein each cutting void within the intermesh region of the composite cutting profile has a depth less than 50% of the extension height of any cutter element in the intermesh region of the composite cutting profile.

30. The drill bit of claim 29 wherein each cutting void within the intermesh region of the composite cutting profile has a depth less than 33% of the extension height of any cutter element in the intermesh region of the composite cutting profile.

31. The drill bit of claim 26 wherein each cutting void within the intermesh region of the composite cutting profile has a depth less than 20% of the extension height of any cutter element in the intermesh region of the composite cutting profile.

32. The drill bit of claim 26 wherein each cone cutter includes a first array of cutter elements mounted within a first band and a second array of cutter elements mounted within a second band spaced axially apart from the first band, wherein the cutter elements in each array are mounted in a plurality of differing radial positions relative to the bit axis, and wherein the first array and second array of one cone cutter are mounted within the intermesh region of each cone.

33. The drill bit of claim 26 wherein each cutter element has a central axis and wherein the cutting profile of at least two cutter elements in one of said arrays includes at least two cutter elements having skewed axes relative to each other.

34. The drill bit of claim 33 wherein the cutting profile of each array includes at least two cutter elements having skewed axes relative to each other.

35. A drill bit for drilling through earthen formations and forming a borehole, the bit comprising:

a bit body having a bit axis;

at least two rolling cone cutters mounted on the bit body and adapted for rotation about a different cone axis, wherein each cone cutter includes an intermesh region;

an array of cutter elements mounted in a plurality of differing radial positions within a band disposed in the intermesh region of one rolling cone cutter, wherein each cutter element within the array has a central axis; and wherein the cutter elements of the array form a cutting profile when rotated into a single plane that includes at least two cutter elements having skewed axes relative to one another.

36. The drill bit of claim 35 wherein each cone cutter comprises an array of cutter elements mounted in a plurality of differing radial positions within a band disposed in the intermesh region, wherein each cutter element has a central axis; and wherein the cutter elements of each array form a cutting profile when rotated into a single plane that includes at least two cutter elements having skewed axes relative to one another.

37. The drill bit of claim 36 wherein the cutter elements mounted to each cone cutter form a composite cutting profile when the at least two cones are rotated into a single plane, and wherein the cutting profile of each array at least partially overlaps with the cutting profile of another array on an adjacent cone in the composite cutting profile.

38. The drill bit of claim 37 wherein each cutter element of each array has an extension height; and wherein the composite cutting comprises an intermesh region including a plurality of cutting voids, wherein each cutting void within the intermesh region of the composite cutting profile has a depth less than 75% of the extension height of any cutter element within the intermesh region of the composite cutting profile.

39. The drill bit of claim 38 wherein each cutting void within the intermesh region of the composite cutting profile has a depth less than 50% of the extension height of any cutter element in the intermesh region of the composite cutting profile.

40. The drill bit of claim 35 comprising N cutter elements in each array disposed in at least P differing radial positions, where P is at least three.

41. The drill bit of claim 40 wherein P is at least four.

42. A drill bit for creating a borehole in earthen formations, comprising:

a bit body having a bit axis;

a plurality of rolling cone cutters mounted on the bit body and adapted for rotation about a different cone axis, wherein each cone cutter includes an intermesh region;

a first array of cutter elements mounted in a plurality of differing radial positions within a band disposed in the intermesh region of a first cone cutter, wherein the cutter elements of the first array for a cutting profile when rotated into a single plane;

a plurality of cutter elements mounted in the intermesh region of a second cone cutter that form a cutting profile when rotated into a single plane;

wherein each cutter element has an extension height;

wherein the cutter elements mounted on the plurality of cone cutters form a composite cutting profile when the plurality of cone cutters are rotated into a single plane that includes an intermesh region;

wherein the cutting profile of the first array of cutter elements at least partially overlaps with the cutting profile of at least one cutter element of the second cone cutter in the composite cutting profile;

wherein the composite cutting profile includes a cutting void between the cutting profile of the first array of cutter elements and the cutting profile of the at least one cutter element of the second cone that at least partially overlaps with the cutting profile of the first array of cutter elements;

wherein the cutting void has a depth of less than 75% of the extension height of any cutter element in the intermesh region of the composite cutting profile.

43. The drill bit of claim 42 wherein the cutting void has a depth of less than 33% of the extension height of any cutter element in the intermesh region of the composite cutting profile.

44. The drill bit of claim 42 further comprising an second array of cutter elements mounted in a plurality of differing radial positions within a band disposed in the intermesh region of the second cone cutter;

wherein the cutter elements of the second array form a cutting profile when rotated into a single plane;

wherein the cutting profile of the first array of the first cone cutter at least partially overlaps with the cutting profile of the second array of the second cone cutter in the composite cutting profile;

wherein the composite cutting profile includes a cutting void between the cutting profile of the first array and the cutting profile of the second array;

wherein the cutting void has a depth of less than 75% of the extension height of any cutter element in the intermesh region of the composite cutting profile.

45. A drill bit for drilling through earthen formations and forming a borehole, the bit comprising:

a bit body having a bit axis;

a plurality of rolling cone cutters mounted on the bit body and adapted for rotation about a cone axis, wherein each cone cutter includes a plurality of cutter elements, a backface, a nose opposite the backface, a non-intermesh region adjacent the backface, an intermesh region between the non-intermesh region and the nose;

wherein at least one cone cutter on the bit comprises a first array of bottom hole cutter elements mounted in a first band and a second array of bottom hole cutter elements mounted in a second band that is axially spaced apart from the first band relative to the cone axis of the at least one cone cutter in rotated profile view;

wherein the at least one cone cutter comprises a total number X of bottom hole cutter elements positioned in Y different radial positions, where the ratio of Y to X is at least 0.20.

46. The drill bit of claim 45 wherein the ratio of Y to X is at least 0.30.

47. The drill bit of claim 46 wherein the ratio of Y to X is at least 0.40.

* * * * *